US006338320B1

(12) United States Patent
De Ojeda

(10) Patent No.: US 6,338,320 B1
(45) Date of Patent: Jan. 15, 2002

(54) HYDRAULICALLY-ASSISTED ENGINE VALVE ACTUATOR

(75) Inventor: William De Ojeda, Chicago, IL (US)

(73) Assignee: International Truck & Engine Corporation, Warrenville, IL (US)

( * ) Notice: Subject to any disclaimer, the term of this patent is extended or adjusted under 35 U.S.C. 154(b) by 0 days.

(21) Appl. No.: 09/457,908

(22) Filed: Dec. 8, 1999

Related U.S. Application Data

(63) Continuation-in-part of application No. 09/152,497, filed on Sep. 9, 1998, now Pat. No. 6,044,815.

(51) Int. Cl.[7] ..... F01L 9/02

(52) U.S. Cl. ..... 123/90.12; 123/90.11; 123/90.13; 251/30.01

(58) Field of Search ..... 123/90.12, 90.13; 251/30.01

(56) References Cited

U.S. PATENT DOCUMENTS

| | | | | |
|---|---|---|---|---|
| 4,200,067 A | * | 4/1980 | Trenne | 123/90.12 |
| 4,212,323 A | * | 7/1980 | Qureshi | 137/625.61 |
| 5,012,778 A | | 5/1991 | Pitzi | |
| 5,191,867 A | | 3/1993 | Glassey | |
| 5,224,683 A | | 7/1993 | Richeson | |
| 5,248,123 A | | 9/1993 | Richeson et al. | |
| 5,287,829 A | | 2/1994 | Rose | |
| 5,339,777 A | | 8/1994 | Cannon | |
| 5,392,749 A | | 2/1995 | Stockner | |
| 5,410,994 A | | 5/1995 | Schechter | |
| 5,419,301 A | | 5/1995 | Schecheter | |
| 5,421,359 A | | 6/1995 | Meister et al. | |
| 5,448,973 A | | 9/1995 | Meyer | |
| 5,456,221 A | | 10/1995 | Schechter | |
| 5,456,222 A | | 10/1995 | Schechter | |
| 5,456,223 A | | 10/1995 | Miller et al. | |
| 5,529,030 A | | 6/1996 | Rose | |
| RE35,303 E | | 7/1996 | Miller et al. | |
| 5,595,148 A | | 1/1997 | Letsche et al. | |
| 5,636,602 A | | 6/1997 | Meister | |
| 5,638,781 A | | 6/1997 | Sturman | |
| 5,787,858 A | * | 8/1998 | Meneely | 123/321 |
| 5,970,956 A | | 10/1999 | Sturman | |

FOREIGN PATENT DOCUMENTS

| | | | |
|---|---|---|---|
| FR | 2480854 | * 10/1981 | 123/90.12 |
| SU | 1132034 | * 12/1984 | 123/90.12 |

* cited by examiner

*Primary Examiner*—Thomas Denion
*Assistant Examiner*—Jaime Corrigan
(74) *Attorney, Agent, or Firm*—Dennis Kelly Sullivan; Jeffrey P. Calfa; Gilberto Hernandez

(57) ABSTRACT

A hydraulically-assisted engine valve actuator and method for assisting in the actuation of an engine valve includes a translatable pilot valve that is operably coupled to and controlled by a pilot valve positioning system. A servo piston is in fluid communication with the pilot valve and is operably coupled to the engine valve. The pilot valve positioning system controls translation of the pilot valve to meter hydraulic fluid under pressure to and from the servo piston. The hydraulic fluid under pressure causes the servo piston to closely follow the translation of the pilot valve to effect a desired profile of translational opening and closing motion of the engine valve.

46 Claims, 14 Drawing Sheets

FIG. 2
OPEN STROKE
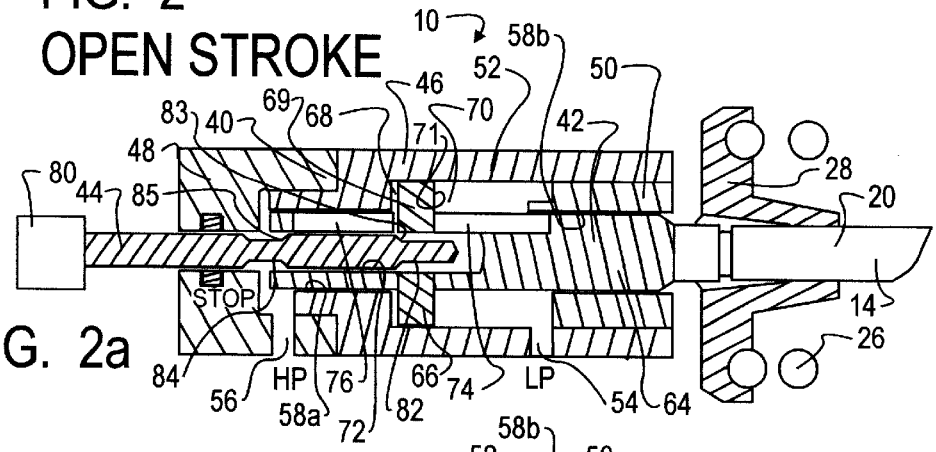
FIG. 2a
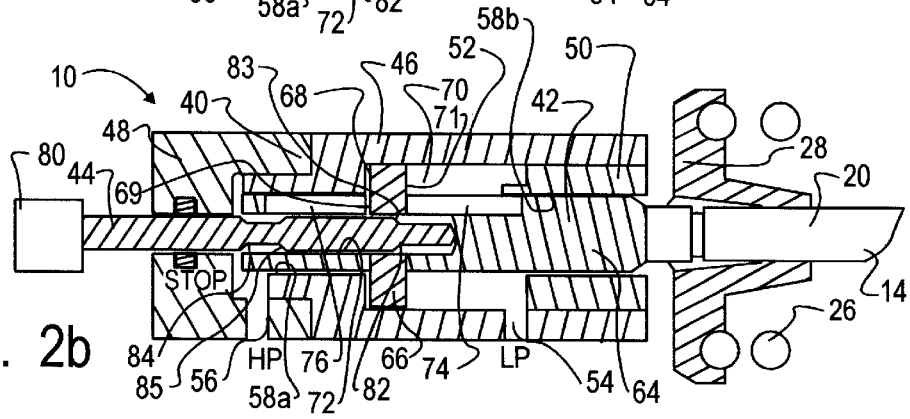
FIG. 2b
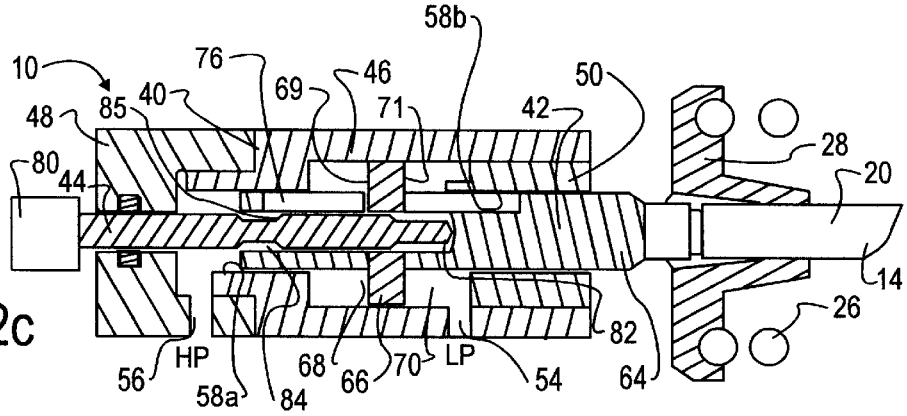
FIG. 2c
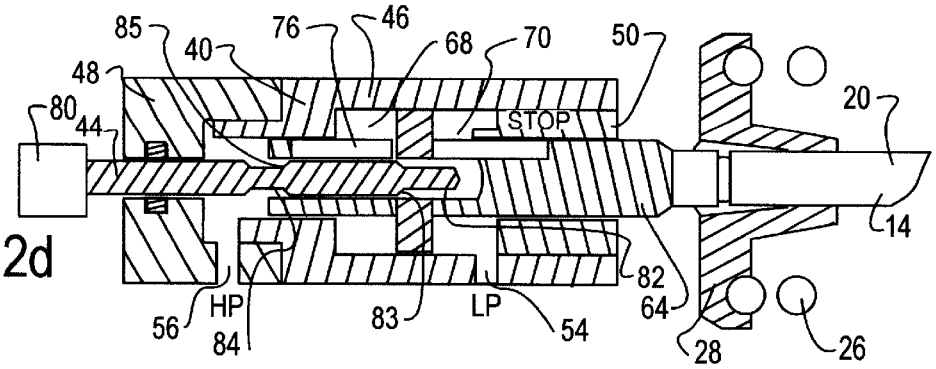
FIG. 2d FIG. 3
CLOSE STROKE
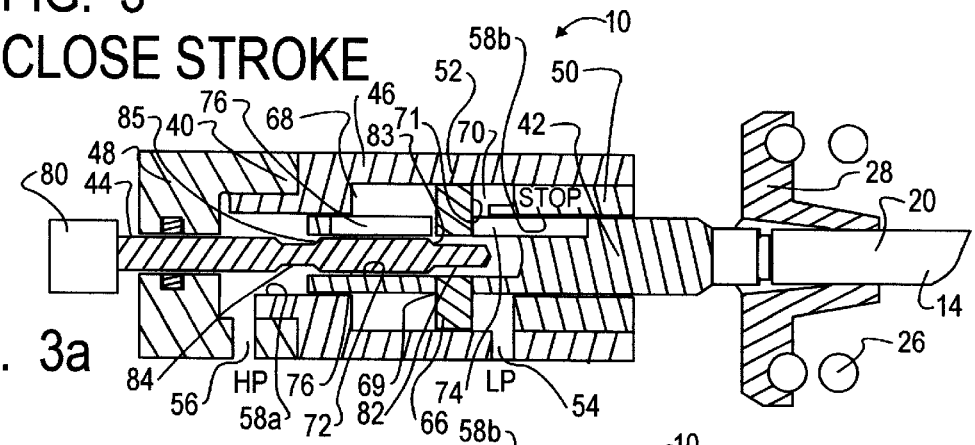
FIG. 3a
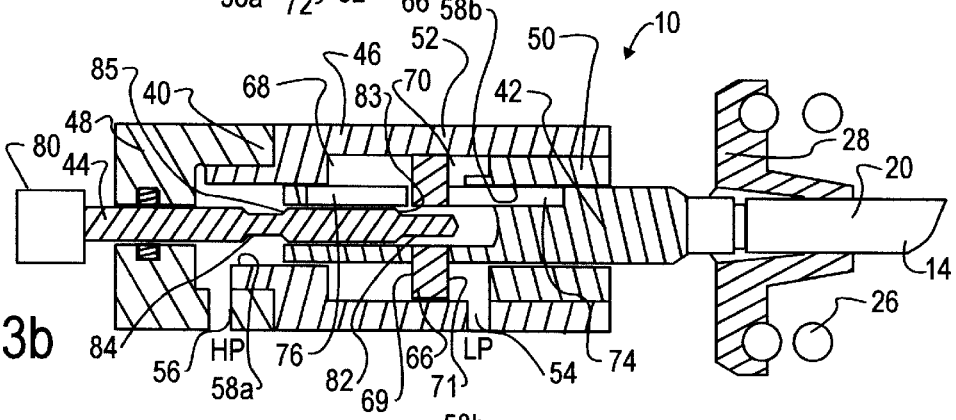
FIG. 3b
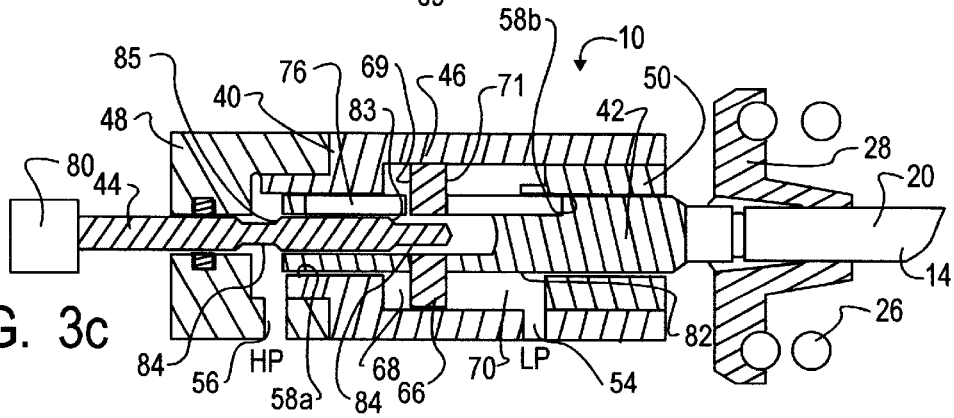
FIG. 3c
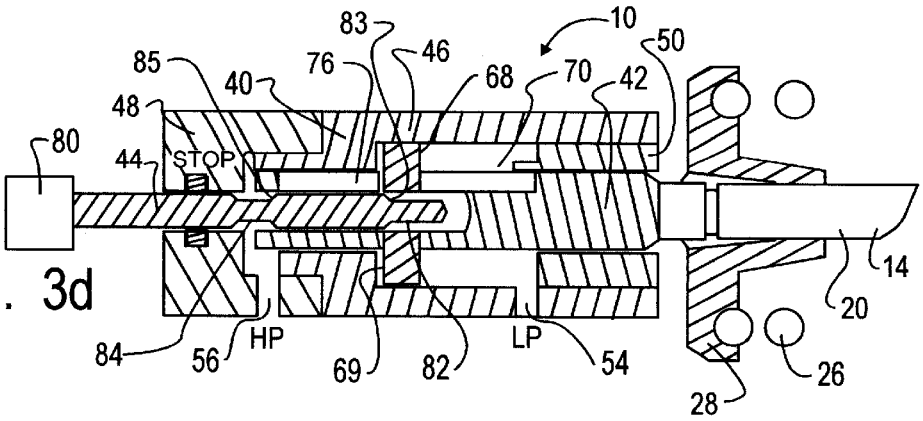
FIG. 3d

HYDRAULICALLY-ASSISTED ENGINE VALVE ACTUATOR

RELATED APPLICATIONS

The present application is a continuation-in-part application of U.S. patent application Ser. No. 09/152,497, filed Sept. 9, 1998 now U.S. Pat. No. 6,044,815.

TECHNICAL FIELD

The present invention relates to internal combustion engines. More particularly, the present invention relates to engine valve actuation.

BACKGROUND OF THE INVENTION

It is desirable that a hydraulically-assisted engine valve actuator provide for flexible engine valve operation under a wide band of engine operating conditions. The hydraulically-assisted engine valve actuator should provide for variable valve timing of closing and opening and variable lift as desired in order to achieve the greatest engine efficiencies. Presently, hydraulic fluid is supplied to hydraulically actuated valves through tubes commonly called rails. Valve motion profiles in current hydraulic actuation designs depend on a pre-established constant value of oil pressure at the supply rails because rail pressures cannot be adjusted fast enough to modulate valve profiles. The constant rail pressure values result in constant valve profiles regardless of engine rpm.

Present hydraulic actuation schemes add complexity to the engine design. Some hydraulic actuation designs rely on additional hydraulic supply rails at constant pressure levels. Further, hydraulic actuation that relies on on/off solenoid (spool or poppet) valve operations require engine valve position sensors for reliable timing of the solenoids and for safe operation. The plurality of sensors required, further adds to the engine complexity.

A hydraulically-assisted engine valve actuator should provide for uniform valve actuation over a wide range of hydraulic fluid temperatures. Present hydraulic actuation schemes typically rely on mechanical damping mechanisms for seating in order to prevent the valve from seating too rapidly. Such mechanisms are typically very dependent on oil temperature, leading to nonuniform valve actuation characteristics.

There is further a need to ensure the opening of an engine exhaust valve, especially under conditions of very high compression forces in the combustion chamber of the engine. Such conditions occur, for example, during compression braking of the engine. Where hydraulic actuation is utilized for such exhaust valve opening, it is important to minimize the volume of hydraulic actuation fluid that is necessary to effect the valve opening.

SUMMARY OF THE INVENTION

The hydraulically-assisted engine valve actuator of the present invention allows for flexible engine valve operation: variable valve timing of the closing and the opening and variable valve lift. Further, the mechanical components needed to effect the hydraulic actuation are relatively simple, thereby minimizing the additional engine components required. No sensors or mechanical damping mechanisms are needed. Additionally, the hydraulic actuation of the present invention is designed to provide for uniform actuation over a wide range of hydraulic fluid temperatures and viscosities.

The foregoing advantages of the present invention are effected by the use of fine needle control. The fine needle control provides for modulation of engine valve profiles: varying engine profiles at varying engine speeds, varying the shape of the profiles at a given rpm. The present invention further allows aggressive valve openings and closings which translates into better volumetric efficiency of the engine.

The hydraulically-assisted engine valve actuator of the present invention is not sensitive to pressure variation in the high-pressure rail, that is, the modulation of engine valve motion is capable of tolerating a substantial variation of pressure (above a predetermined threshold pressure) in the high-pressure rail.

The low-pressure line in an embodiment of the present invention is shared with the existing lubricating oil supply. In an embodiment of the present invention, only a high-pressure supply line is required. Spent hydraulic actuation fluid is vented to the engine oil pan or reservoir. In the case of engines with a fuel injection system incorporating a high-pressure rail, the same high pressure fluid supply is used for valve actuation in order to further minimize the added components to the engine.

In the case of the present invention, the output, i.e. the engine valve position, very closely follows the input to the hydraulic actuator. Therefore, the device of the present invention does not require the added complexity of requiring a sensor to measure engine valve position for feedback control. Accurate control of valve seating is attained by accurate control of the needle at the end of the stroke.

The present invention further provides very good cold temperature operating performance despite the hydraulic actuating fluid preferably being lubricating oil. The proportional flow areas of the hydraulic fluid passages are not so small as to compromise performance under variable operating temperatures. This is especially important in cold temperature operation since the viscosity of hydraulic fluid, particularly lubricating oil, is significantly higher when the engine is cold than after the engine has warmed up.

In one embodiment, the invention incorporates a power piston to assist in opening the exhaust valve of the engine. The power piston operates with each cycle of the engine valve and does not require a separate valve that is dedicated to control of the power piston, as is the case with known power pistons. Additionally, the stroke of the power piston is limited to that necessary to only crack open the exhaust valve. Once the exhaust valve is cracked open, the compressive forces in the combustion chamber are relieved and the servo piston alone can complete the full opening of the exhaust valve without the assistance of the power piston. By limiting the stroke of the power piston, the volume of high pressure actuating fluid necessary to activate the power piston is minimized.

Further, the mechanical components that are required for valve actuation by the present invention do not significantly increase the engine complexity, i.e., very few modifications to an existing cylinder head are needed in order to incorporate the valve actuator assembly of the present invention.

BRIEF DESCRIPTION OF THE DRAWINGS

FIGS. 2*a*–2*b* depict the valve opening cycle. Specifically, FIG. 2*a* is a side elevational view in section of the valve actuator with the actuator and the valve in the closed retracted configuration;

FIG. 2*b* is a side elevational view in section of the valve actuator with the actuator needle commencing translation to the right and the valve in the closed retracted configuration;

FIG. 2*c* is a side elevational view in section of the valve actuator with the actuator needle in a rightward position and the valve approaching the open extended configuration;

FIG. 2*d* is a side elevational view in section of the valve actuator with the actuator needle and valve stopped in the open extended configuration;

FIGS. 3*a*–3*b* depict the valve closing cycle. Specifically, FIG. 3*a* is a side elevational view in section of the valve actuator with the actuator needle and the valve in the open extended configuration;

FIG. 3*b* is a side elevational view in section of the valve actuator with the actuator needle and the valve in the open extended configuration, the actuator needle having translated to the left exposing the extender chamber to low pressure hydraulic fluid;

FIG. 3*c* is a side elevational view in section of the valve actuator with the valve in transition between the open extended configuration and the closed retracted configuration, the actuator needle having translated to the left exposing the extender chamber to low pressure hydraulic fluid;

FIG. 3*d* is a side elevational view in section of the valve actuator with the actuator needle and valve in the closed retracted configuration;

FIG. 4*a* is a graph of actuator and valve displacement over time;

FIG. 4*b* is a graph of the flow of high pressure hydraulic fluid to the actuator over time;

FIG. 5*a* is a side elevational view in section of the valve actuator with the actuator and valve in the closed retracted configuration just prior to the valve downstroke;

FIG. 5*b* is a side elevational view in section of the valve actuator with the actuator needle commencing translation to the downward and the valve in the closed retracted configuration;

DETAILED DESCRIPTION OF THE PREFERRED EMBODIMENT

Figure 1:
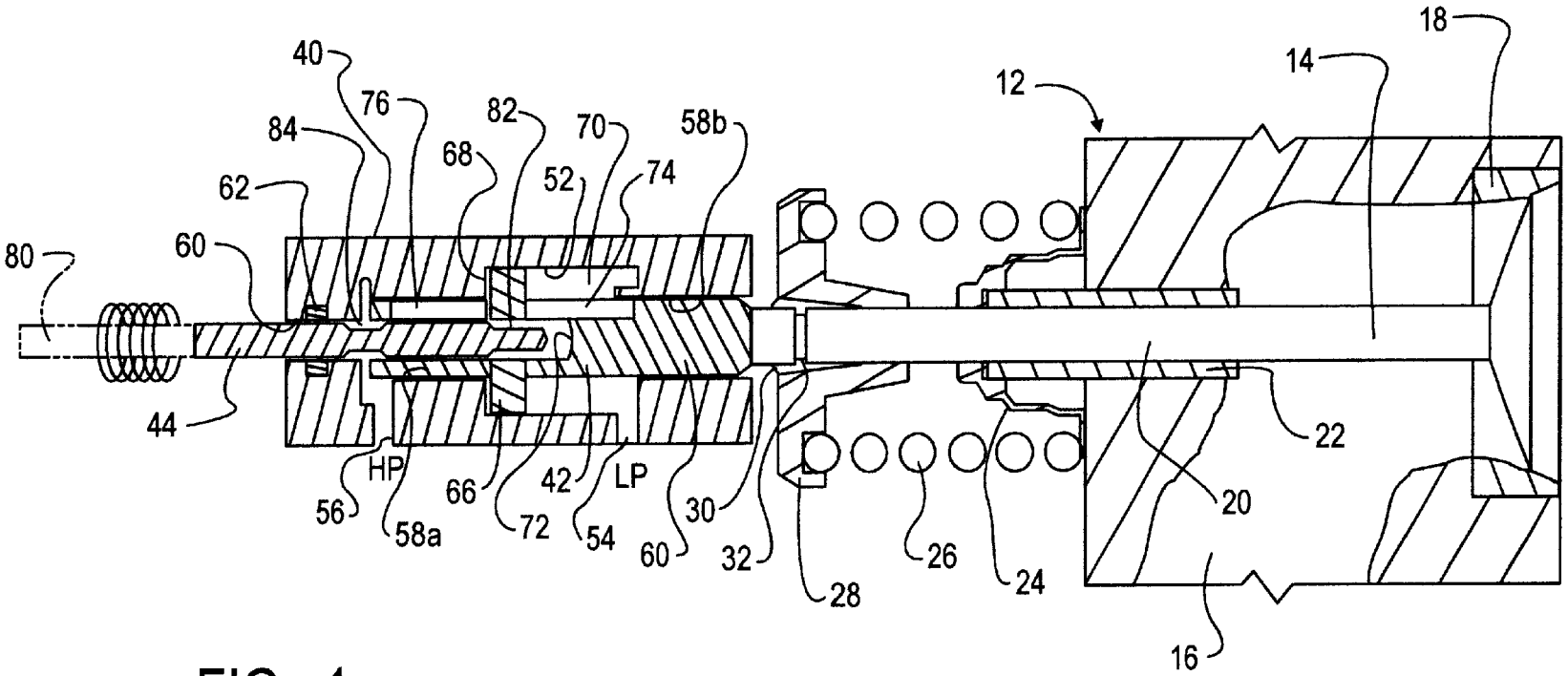
FIG. 1 is a side elevational view in section of the hydraulically-assisted engine valve actuator of the present invention coupled to an engine valve.
Figure 4:
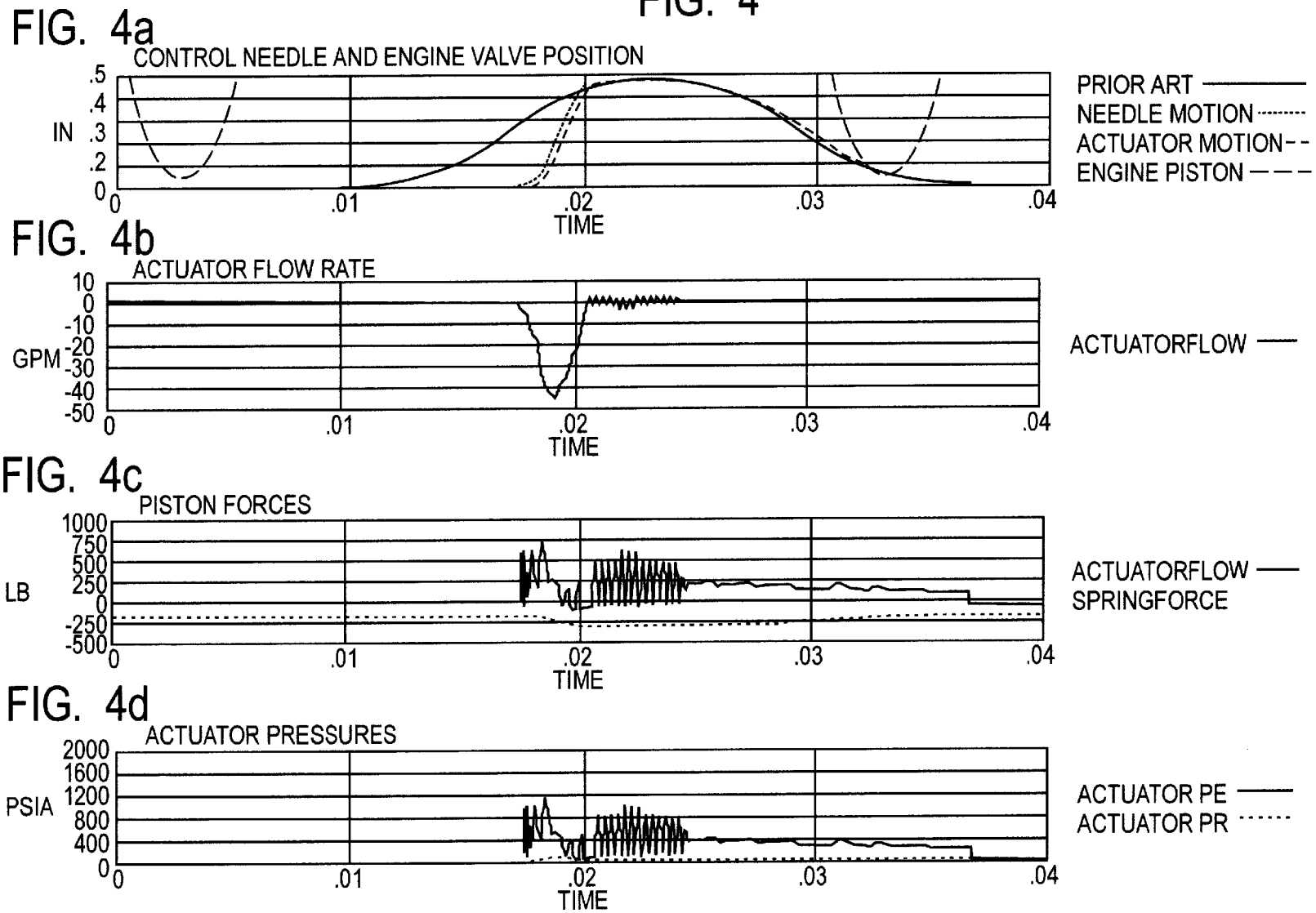
FIGS. 4*a*–4*b* depict various actuator and valve parameters on a common time base, the valve being actuated by the valve actuator of the present invention. Specifically.
FIG. 4*c* is a graph of force on the actuator piston and the valve spring force over time.
FIG. 4*d* is a graph of actuator pressure in the extender and retractor chambers over time.

The hydraulically assisted engine valve actuator of the present invention is shown generally at 10 in FIGS. 1–5*f*. In FIG. 1, actuator 10 is depicted coupled to an engine head 12.

The engine head 12 has a valve 14 translatably disposed therein. The valve 14 opens and closes an intake/exhaust passageway 16. Intake/exhaust passageway 16 is either an intake passageway or an exhaust passageway depending on whether the valve 14 is an intake valve or an exhaust valve. For the purposes of the present invention depicted in FIGS. 1–5*f*, valve 14 can be either an intake or an exhaust valve.

In the depiction of FIG. 1, valve 14 is in the closed configuration seated on valve seat 18. An elongate cylindrical valve stem 20 is translatably borne within a valve guide 22. A valve seal 24 mounted on the engine head 12 prevents fluids from escaping around the valve stem 20.

A coil valve spring 26 is disposed concentric with the valve stem 20 and has a first end bearing on the engine head 12. The second end of the valve spring 26 is retained within a valve rotator 28. The valve spring 26 is preferably maintained in a state of compression between the valve rotator 28 and the engine head 12 when the valve 14 is either in the open or closed configurations, compression of valve spring 26 being greatest when the valve 14 is open. A valve keeper 30 has a portion thereof disposed within a keeper groove 32 formed circumferential to the valve stem 20. The valve keeper 30 holds the valve rotator 28 in engagement with the valve stem 20.

The hydraulic actuator 10 of the present invention includes three major components: actuator casing 40, actuator piston 42, and needle 44.

Referring to FIG. 2*a*, the actuator casing 40 is preferably formed of three components: a centrally disposed casing body 46, a casing cap 48, and a casing insert 50. Referring again to FIG. 1, the casing body 46 of the actuator casing 40 has a cylinder bore 52 defined concentric with the longitudinal axis of the actuator casing 40. A low pressure (LP) fluid passageway 54 is defined between the casing body 46 and the casing insert 50. LP fluid passageway 54 extends from the exterior of the actuator casing 40 to intersect the cylinder bore 52.

A piston bore 58*a*, 58*b* is defined concentric with the longitudinal axis of the actuator casing 40 and the casing body 46 and casing insert 50, respectively. The piston bore 58*a*, 58*b* is generally cylindrical, having a diameter that is substantially less than the diameter of the cylinder bore 52. A high pressure (HP) fluid passageway 56 is defined between the casing body 46 and the casing cap 48. HP fluid passageway 56 intersects the piston bore 58*a*.

A needle bore 60 is defined in the casing cap 48 of the actuator casing 40. An O-ring seal groove 62 is defined circumferential to the needle bore 60.

The actuator piston 42 has a cylindrical piston body 64 and a piston head 66. The piston body 64 has a generally elongate cylindrical shape. The piston body 64 is operably coupled at a first end to the end of the valve stem 20 of the valve 14. A needle bore 72 is defined in the second end of the piston body 64. The needle bore 72 extends approximately half the longitudinal dimension of the piston body 64. The needle bore 72 is concentric with the longitudinal axis of the actuator piston 42. The piston body 64 is slideably disposed within the piston bore 58*a*, 58*b*.

The piston head 66 is a generally cylindrical shape. The diameter of the piston head 66 is substantially greater than the diameter of the piston body 64. The piston head 66 is disposed within the cylinder bore 52 defined within the actuator casing 40. As depicted in FIG. 1, the piston head 66 divides the cylinder bore 52 into a left variable volume extender chamber 68 and a right variable volume retractor chamber 70. The piston body 64 is translatable within the piston bore 58*a*, 58*b*, and the piston head 66 is translatable therewith within the cylinder bore 52. Such translation in the cylinder bore 52 acts to simultaneously change the volume of the extender chamber 68 and the retractor chamber 70, increasing the volume of one chamber while decreasing the volume of the other chamber.

A plurality of fluted passageways 74 extend through the piston body 64 to accommodate the flow of hydraulic fluid from the LP fluid passageway 54 to the extender chamber 68 (depending on the position of the needle 44) and to the retractor chamber 70. A plurality of fluted passageways 76 extend through the piston body 64 to accommodate the flow of hydraulic fluid from the HP fluid passageway 56 to the extender chamber 68.

The third component of the hydraulic actuator 10 is the needle 44. The needle 44 is a generally elongate cylindrical rod. The needle 44 is disposed at least partially in the needle bore 72 defined in the piston body 64. The needle 44 extends through the needle bore 60 defined in the casing cap 48 of the actuator casing 40. An O-ring 65 disposed in the O-ring seal groove 62 effects a fluid seal between the needle 44 and the needle bore 60. The needle 44 is slideably translatably disposed within both the needle bore 60 and the needle bore 72.

The needle 44 extends beyond the casing cap 48 and is operably coupled to a needle positioning mechanism 80. In the depiction of FIG. 1, needle positioning mechanism 80 is a solenoid. Needle positioning mechanism 80 may also be the lobe of a cam or a stepper motor or other suitable positioner as desired.

The inward directed end of the needle 44 is shaped to form a spool valve including a first end groove 82. Groove 82 has a diameter that is substantially less than the inside diameter of the needle bore 72, thereby defining an annular fluid passageway between the first end groove 82 and the needle bore 72. A second groove 84 is defined at approximately the center point along the longitudinal axis of the needle 44. The second groove 84 also has a diameter that is substantially less than the diameter of needle bore 72, thereby defining an annular fluid passageway between the second groove 84 and the needle bore 72.

Operation of Invention

In operation, the hydraulically assisted engine valve actuator 10 relies on low and high pressure fluid. A source of low pressure hydraulic fluid, such as engine lubricating oil, under pressure as the oil is circulated through the engine for lubricating purposes, is operably coupled to the LP fluid passageway 54. A source of high pressure fluid, such as engine oil under pressure as necessary to operate some engine fuel injectors. This source may be operably coupled to the HP fluid passageway 56. Such a high pressure source is described in connection with a hydraulically-actuated, electronically-controlled unit fuel injector system in U.S. Pat. Nos. 5,191,867 and 5,392,749 which are incorporated by reference herein. Translational movement of the needle 44 responsive to input from the needle positioning mechanism 80 distributes hydraulic fluid into and out of the extender chamber 68 and the retractor chamber 70 defined by the position of the piston head 66 of the actuator piston 42 to act on the piston head 66 in such a way (described in detail in the following section) that the actuator piston 42 (and the valve 14 position) very closely follow the translational movement of the needle 44.

The actuator piston 42 acts directly on the engine valve 14, the engine valve 14 being biased to the closed position by the valve spring 26. The valve spring 26 always exerts a leftward directed force on the actuating piston 42, as depicted in FIGS. 1–3*d*. The actuator piston 42 has sufficient rightward directed force, when motivated by high pressure hydraulic fluid, to overcome the opposing bias of the spring 26 and the opposing force of any combustion forces acting on the engine valve 14 in order to open the valve 14.

Translational motion of the needle 44 is not opposed by the spring 26 or the combustion forces and therefore requires only a minimal force exerted by the needle positioning mechanism 80 to effect translation. The needle 44 may be effectively controlled to describe a prescribed valve 14 opening/closing profile. In a preferred embodiment, the actuating force necessary to translate the needle 44 is less than 12 pounds and more preferably is substantially about 6 pounds. The translational position of the needle 44 controls the position of the engine valve 14. Positioning the valve 14 requires a much larger force input than the force input needed to position the needle 44. This much larger force input is available by means of the high pressure hydraulic fluid acting in the extender chamber 68 acting on the actuator piston 42. In this regard, the actuator 10 is a servo follower system. Control is maintained of the needle 44 by the needle positioning system 80. The needle 44 acts as a servo pilot with the actuator piston 42 being the servo main stage and following the needle 44. The force needed to actuate needle 44 is relatively very small compared to the forces that follow the needle 44. This greatly reduces the mass and complexity of the components needed to effect actuation of the valve 14.

FIGS. 2*a*–2*d* depict the opening stroke of the valve 14, sequentially progressing from the closed position in FIG. 2*a* to the open position in FIG. 2*d*. In FIG. 2*a*, the engine valve 14 is initially resting against the valve seat 18 through action of the bias exerted by the valve spring 26. The needle 44 and actuator piston 42 are fully retracted to the leftmost position. Low-pressure fluid enters the LP fluid passageway 54 and flows through the fluted passageways 74 to fill the retractor chamber 70 and then flows through the fluid passageway defined by the first end groove 82 to flood the extender chamber 68 of the actuator piston 42. With low pressure hydraulic fluid acting on both sides 69, 71 of the piston head 66, the actuator piston 42 is in a state of hydraulic equilibrium. No hydraulically generated force is acting to counter the force of the spring 26.

Referring to FIG. 2*b*, the needle positioning mechanism 80 translates the needle 44 rightward. First, such translation advances the shoulder 83 of the first end groove 82 of the needle 44, sealing the extender chamber 68 from the retractor chamber 70. Second, as the needle 44 continues to translate rightward, the needle 44 allows the high pressure fluid supply from HP fluid passageway 56 to flow through the second groove 84 and through the fluted passageways 76. The high pressure fluid communicates with the extender chamber 68 and bears on the extender side face 69 of the piston head 66. Extender side face 69 forms a portion of the variable volume extender chamber 68. It should be noted that the low pressure fluid is always acting on the retractor side face 71 of the piston head that forms a portion of the retractor chamber 70. The high pressure oil in the extender chamber 68 drives the actuator piston 42 and engine valve 14 to the open position (FIG. 2*c*), overcoming the opposing force of the spring 26 and the opposing force of the low pressure fluid acting on the side 71 of the piston head 66 that forms a portion of the retractor chamber 70. In a preferred embodiment, the high pressure fluid operates in a pressure range of approximately 450 psi to 3000 psi and the low pressure fluid operates at a pressure of approximately 50 psi.

The rate of rightward translational displacement of the needle 44 determines the area of the fluid passageway opening defined between the second groove 84 and the fluted passageways 76 to the extender chamber 68 and thereby meters the high pressure fluid from the high pressure supply at the HP fluid passageway 56 that is available to act upon the side 69 of the piston head 66 that forms a portion of the extender chamber 68. This metering permits control of the opening profile of the valve 26, as desired. The faster the needle 44 continues to move rightward, the less the throttling effected on the high-pressure oil and the greater the volume of the high pressure fluid supply that the needle 44 allows to communicate with the extender chamber 68 to act upon the side 69 of the piston head 66 that forms a portion of the extender chamber 68. The high pressure fluid in the extender chamber 68 drives the actuator piston 42 and engine valve 14 to the opening position, overcoming the force of the spring 26 and the opposing force of the low pressure fluid acting on the side 71 of the piston head 66 that forms a portion of the retractor chamber 70.

Conversely, the slower the displacement of the needle 44, the less area of the fluid passageway defined by the second groove 84 that is open to the fluted passageways 76 and thence to the extender chamber 68 and the greater the throttling effect on the high pressure oil. The resulting lower high pressure oil volume in the extender chamber 68 results in less force available to overcome the force of the spring 26, compression or combustion forces acting to close the engine valve 14, and the opposing force of the low pressure fluid acting on the side 71 of the piston head 66 that forms a portion of the retractor chamber 70. This in turn results in slower movement of the actuator piston 42 and results in a valve profile that is characterized by slower opening movement of the engine valve 14.

Referring to FIG. 2*d*, when the needle 44 is brought to a stop at its point of greatest rightward translation, the pressure in the extender chamber 68 and the inertia of the actuator piston 42 cause the actuator piston 42 and valve 14 to continue their rightward motion for a short distance until the shoulder 85 of the second groove 84 of the needle 44 seals the fluted passageway 76, preventing further high pressure fluid from affecting the extender chamber 68 of the piston actuator 42. A balance then ensues between the fluid trapped in the extender chamber 68 by the needle 44 and the opposing bias of the spring 26.

The closing stroke of the valve 14 effected by actuator 10 is depicted sequentially in FIGS. 3*a*–3*d*. Referring to FIG. 3*a*, the needle 44 and actuator piston 42 are initially positioned such that the engine valve 14 is unseated at some lift (at least partially open) as a result of the last action in the open stroke referred to with reference to FIG. 2*d* above. The needle 44 seals the extender chamber 68 from both the high and low pressure oil supplies, as previously described in reference to FIG. 2*d*.

Referring to FIG. 3*b* the needle positioning mechanism 80 retreats the needle 44, causing leftward translation of the needle 44. The movement of the needle 44 opens the fluid passageway defined circumferential to the first end groove 82 to fluidly connect the extender chamber 68 to the retractor chamber 70. As previously indicated, the retractor chamber 70 is always exposed to the low pressure oil supply at LP fluid passageway 54. The extender chamber 68 is isolated from the high pressure oil at HP fluid passageway 56 by the needle 44 proximate the second groove 84. The second groove 84 is positioned to isolate the fluted passageways 76 from the high pressure fluid supply at passageway 54. The high pressure fluid in the extender chamber 68 flows into the retractor chamber 70 until extender chamber 68 and the retractor chamber 70 are in a state of hydraulic pressure equilibrium. The force of the spring 26, which is always acting on the actuator piston 42, drives the engine valve 14 and actuator piston 42 leftward towards the closed position, as depicted in FIG. 3*c*.

The rate at which the needle 44 retreats is determined by the needle positioning mechanism 80 and determines the area of the fluid passageway fluidly communicating between the retractor chamber 70 and the extender chamber 68, thereby metering the high pressure fluid flow from the extender chamber 68 to the retractor chamber 70. The force of the spring 26 acts to push the engine valve 14 and actuator piston 42 to the closed position as the high pressure fluid is discharged from the extender chamber 68. The faster that the needle 44 is displaced leftward, the larger the area and the faster the rate at which the oil is discharged from the extender chamber 68 to the retractor chamber 70. The oil in the extender chamber 68 must be displaced in order for the valve 14 to close. The rate of displacement of the needle 44 closely controls the rate of valve 14 closure. Control of the rate of translation of the needle 44 thereby affords close control of the profile of the closing of the valve 14.

When the needle 44 is brought to a stop, as depicted in FIG. 3*d*, the force of the spring 26 and of inertia act to continue the leftward motion of the actuator piston 42 towards the closed position for a small amount of travel after needle 44 stoppage. Such travel continues until the extender chamber 68 is sealed from the retractor chamber 70 by the shoulder of the first end groove 82. A balance then ensues between the fluid pressure in the extender chamber 68 and the retractor chamber 70. The force of the spring 26 continues to act on the actuator piston 42 and the valve 14, maintaining the valve 14 in the seated closed position.

FIGS. 4*a*–4*d* depict a comparison of a cam valve train engine exhaust valve 14 profile with a camless profile effected by the present invention wherein an aggressive valve opening is selected and controlled around bottom dead center. The FIGS. 4*b*–4*d* depict actuator flow rate, piston forces, and actuator pressures corresponding to motion depicted in FIG. 4*a*. The FIG. 4*a* shows the engine piston motion profile, cam valve train profile of a conventional system, needle position of the present invention, and response of the piston actuator of the present invention and engine valve to the needle position input. FIG. 4*a* depicts how closely the output in the form of motion of valve 14 tracks the input in the form of needle 44 position, thus obviating the need for a sensor to track position of the valve 14. FIG. 4*b* depicts flow rate of high pressure oil needed to effect a valve opening and closing cycle. FIG. 4*c* depicts the force of the high pressure oil acting on the actuator 42 in comparison to the opposing force of the spring 26. FIG. 4*d* indicates that the pressure needed to keep the valve open stabilizes at about 400 psi after 0.02 seconds. Virtually any high pressure hydraulic fluid that is above the threshold of about 400 psi is adequate to cause the actuator 10 to function as designed.

Turning now to FIGS. 5*a*–5*f*, a hydraulic schematic of the operation of an embodiment of the hydraulic actuator 10 is depicted sequentially through a downstroke of the valve 14 and an upstroke of the valve 14. In order to effect the downstroke of the valve 14, there are two downward motions that must be considered. First, the actuator piston 42 is coupled to the valve 14 and drives the valve 14 in the downward direction as depicted. Second, the needle 44 translates within the needle bore 72 defined in the actuator piston 42 under the influence of the needle positioning mechanism 80 to control the motion of the actuator piston 42.

Figure 5A:
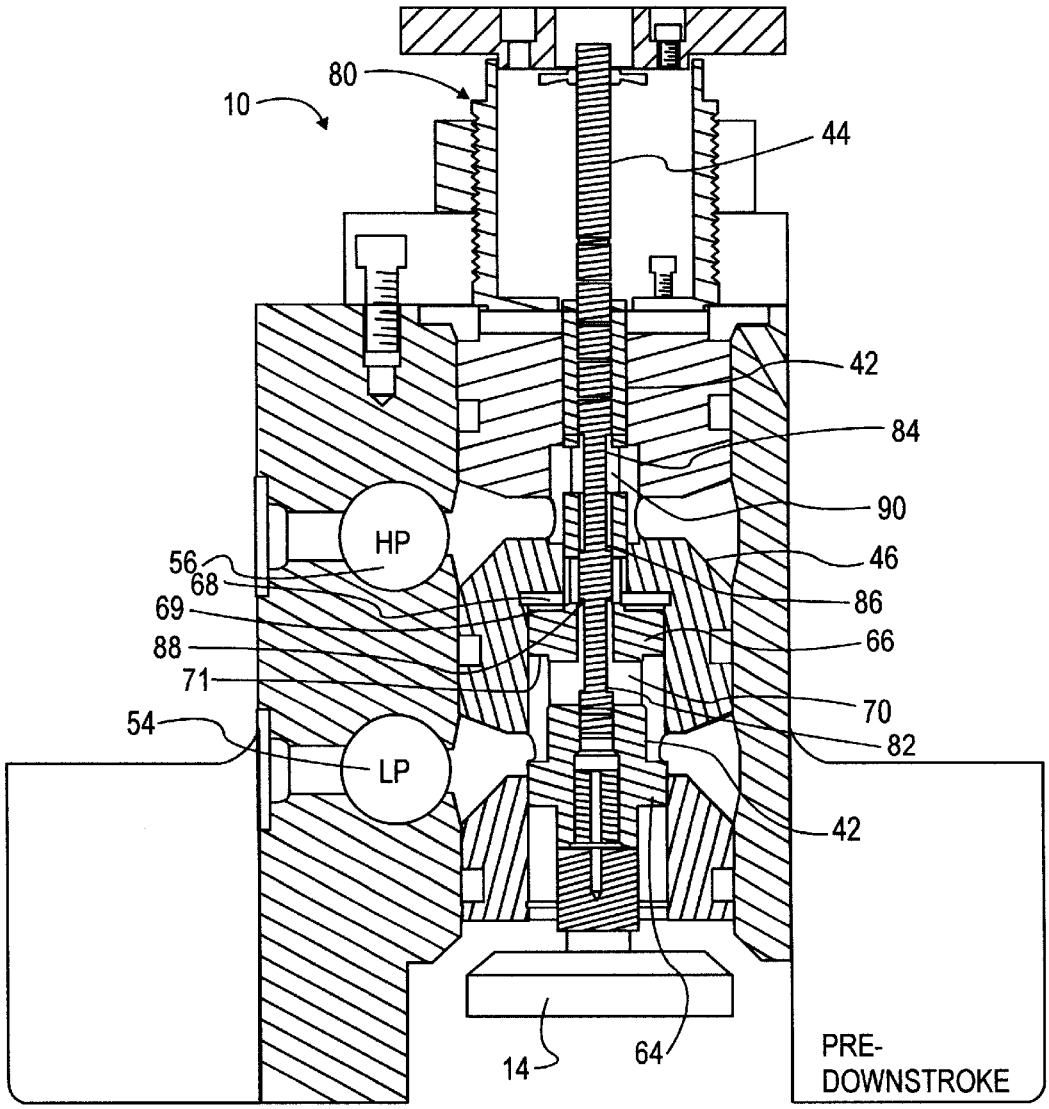
FIGS. 5*a*–5*b* are hydraulic schematics depicting the valve opening cycle and the valve closing cycle in sequence. Specifically.

Prior to commencement of the downstroke of the valve 14, the actuator piston 42 and the needle 44 are in their fully retracted and upward positions as depicted in FIG. 5*a*. High pressure lubricating oil available at the high pressure fluid passageway 56 from a high pressure rail floods the chamber 90 and flows into the second groove 84. The second groove 84 is sealed at its downwardmost end by the shoulder 86 of the needle 44 sealingly engaging the actuator piston 42.

Low pressure engine lubricating oil available at the low pressure fluid passageway 54 from a low pressure rail floods the retractor chamber 70. The low pressure engine lubricating oil is prevented from entering the extender chamber 68 by a sealing engagement of the shoulder 88 of the needle 44 with the actuator piston pin 42.

The valve 14 is kept in its fully upward seated disposition, as depicted in FIG. 5*a*, by the action of the low pressure engine lubricating oil acting on the retractor surface 71 of the piston head 66, in combination with the bias exerted by the valve spring 26. See FIG. 1.

Figure 5B:
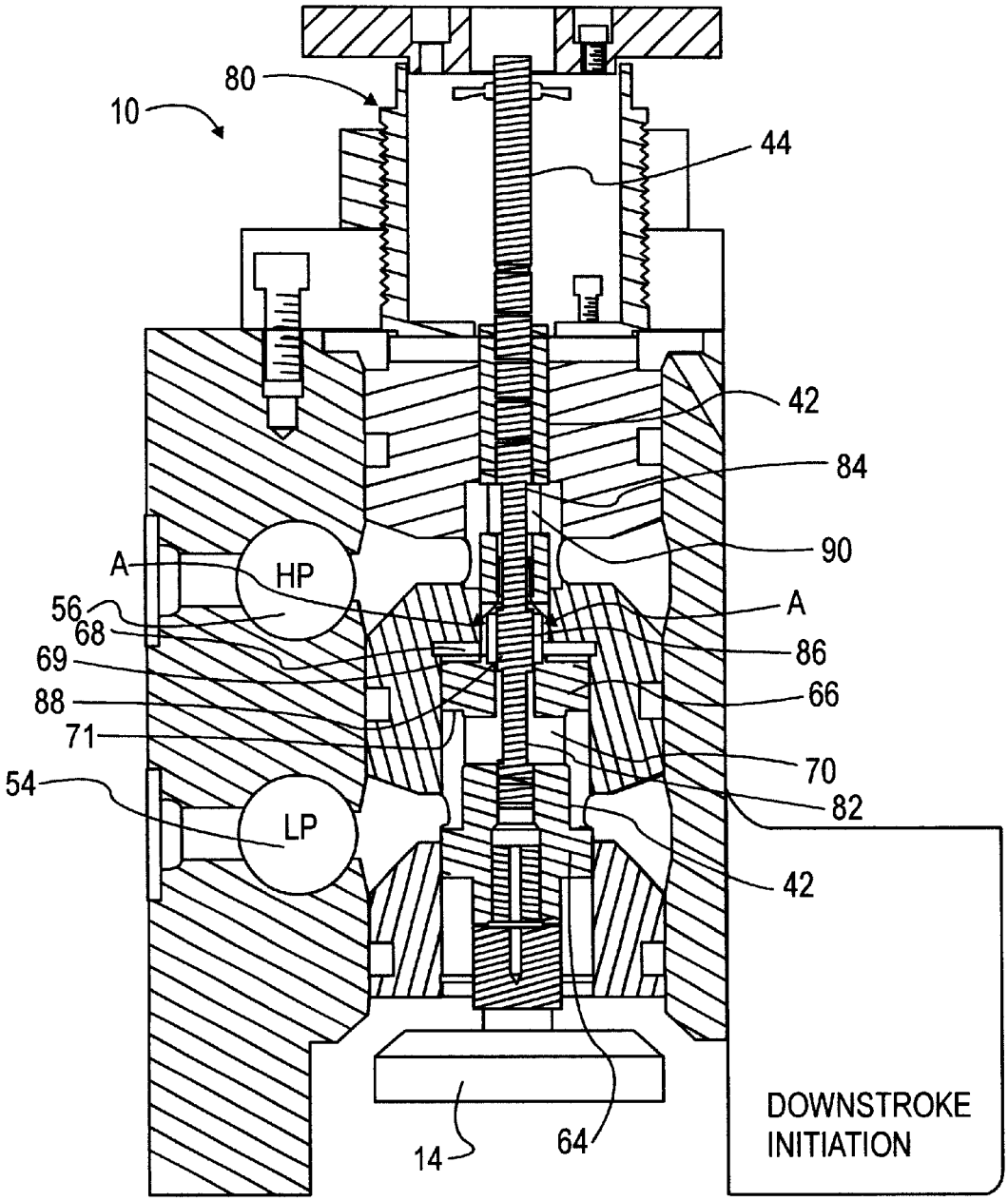

FIG. 5*b* depicts the initiation of the downstroke of the valve 14. In FIG. 5*b*, the needle 44 has translated downward relative to the actuator piston 42 under the actuating influence of the needle positioning mechanism 80. Such downward translation backs the shoulder 86 of the needle 44 out of engagement with the actuator piston 42 to create a fluid passageway through the second groove 84 to the extender chamber 68. High pressure engine lubricating oil flows through the second groove 84 into the extender chamber 68 and bears on the extender surface 69 of the piston head 66. The force exerted by the high pressure engine lubricating oil is sufficient to overcome the countering force exerted by the engine pressure lubricating oil acting on the retractor surface 71 in combination with the bias exerted by the valve spring 26 and any combustion forces acting on the valve 14. Accordingly, translation of the actuator piston 42 and the coupled valve 14 commences downward very closely trailing the translation of the needle 44. The flow of high pressure engine lubricating oil into the extender chamber 68 is depicted by arrows A. The extender chamber 68 remains sealed from the retractor chamber 70 by the sealing action of the shoulder 88 in a sealing relationship with the piston head 66. Low pressure oil continues to flood the retractor chamber 70.

Figure 5C:
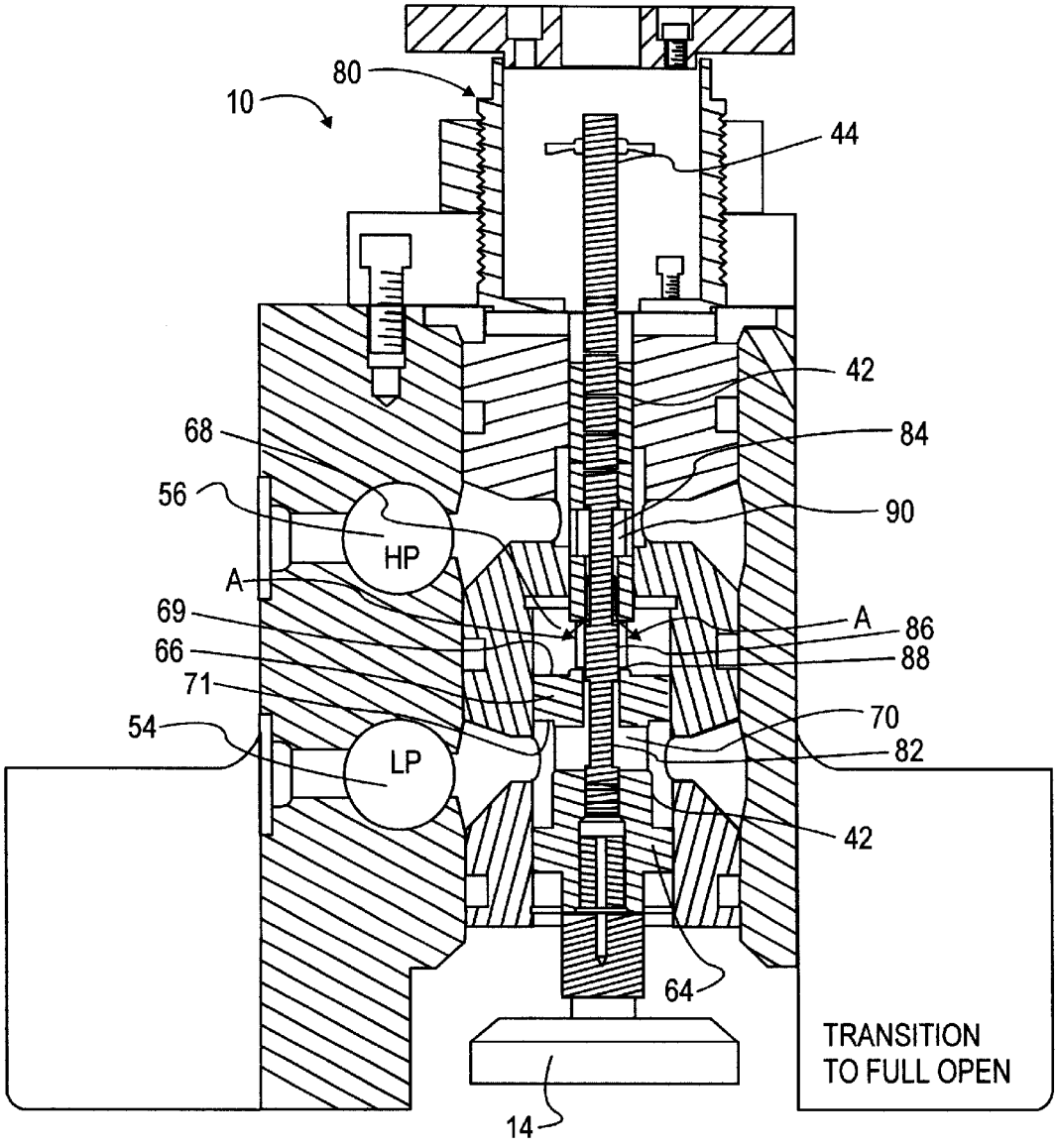
FIG. 5*c* is a side elevational view in section of the valve actuator with the actuator needle in a downward position and the valve approaching the open extended configuration.

FIG. 5*c* depicts the valve 14 as the valve 14 approaches the downward, fully open, unseated position. In the depiction of FIG. 5*c*, the needle 44 has translated downward its full travel. The actuator piston 42 lags slightly behind the needle 44. Accordingly, as indicated by arrows A, high pressure engine lubricating oil continues to flood the extender chamber 68 and to act on the extender surface 69, thereby urging the actuator piston 42 and the valve 14 in the downward direction.

Figure 5D:
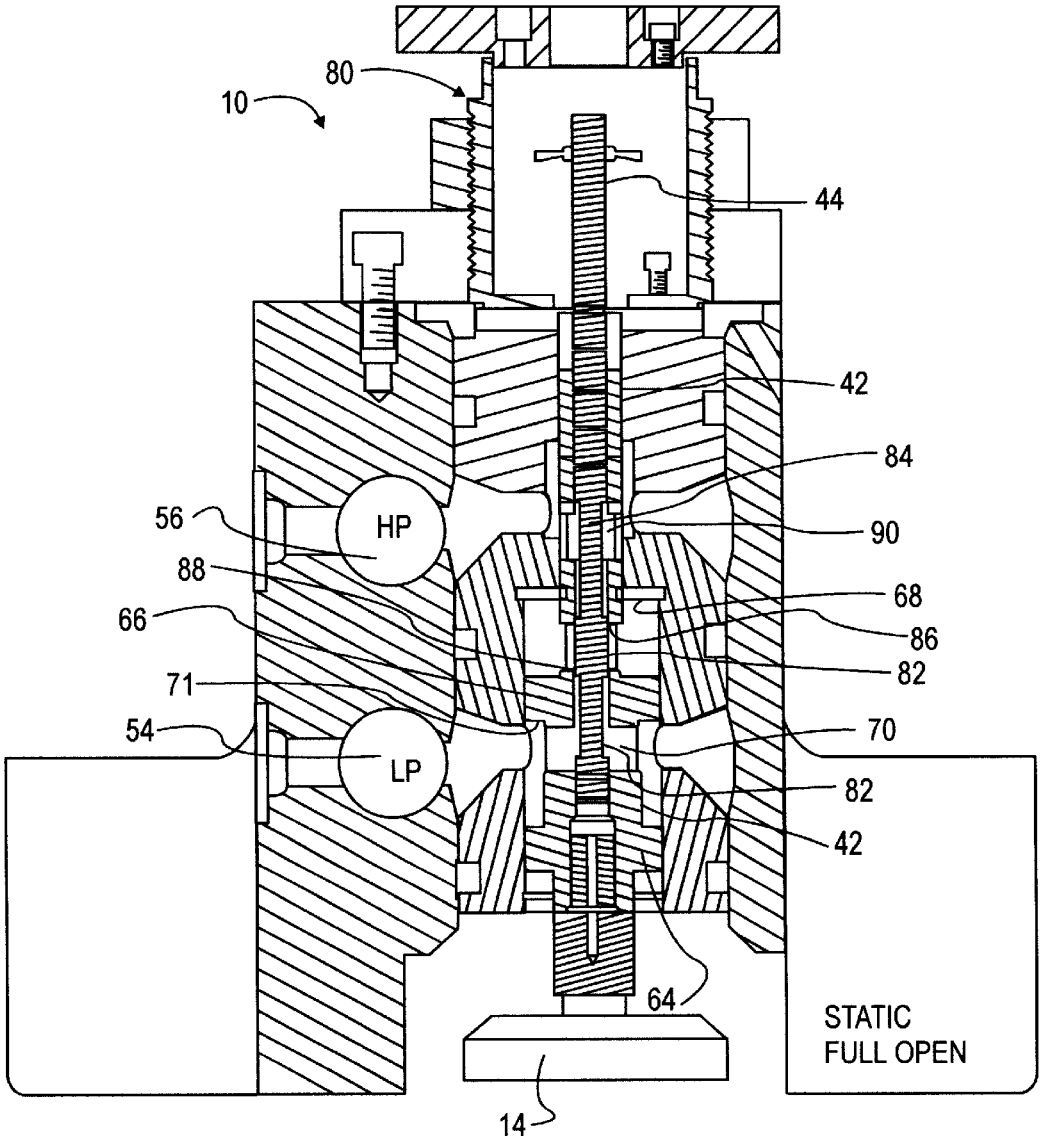
FIG. 5*d* is a side elevational view in section of the valve actuator with the actuator needle and the valve stopped in the open extended configuration.

FIG. 5*d* depicts the valve 14, the actuator piston 42, and the needle 44 all in their fully downward positions. As compared to FIG. 5*c*, the actuator piston 42 has continued to translate downward slightly relative to the needle 44 after motion of the needle 44 has ceased. This translation results generally from the inertia of the actuator piston 42 and the valve 14. Such translation seals the extender chamber 68 by the action of the shoulder 86 of the needle 44 again sealingly engaging the actuator piston 42. Additionally, the shoulder 88 of the needle 44 is in sealing engagement with the actuator piston 42, thereby isolating the retractor chamber 70 from the extender chamber 68. In this position, there is no flow of either high pressure engine lubricating oil or low pressure engine lubricating oil. This is essentially a static position. High pressure engine lubricating oil is sealed within the extender chamber 68 creating a hydraulic lock, preventing the lower pressure engine lubricating oil that is acting on the retractor surface 71 of the piston head 66 (in combination with the bias of the valve spring 26) from moving the actuator piston 42 in an upward direction. Flow into or out of retractor chamber 70 ceases since all passages are sealed and there is no motion of the actuator piston 42.

Figure 5E:
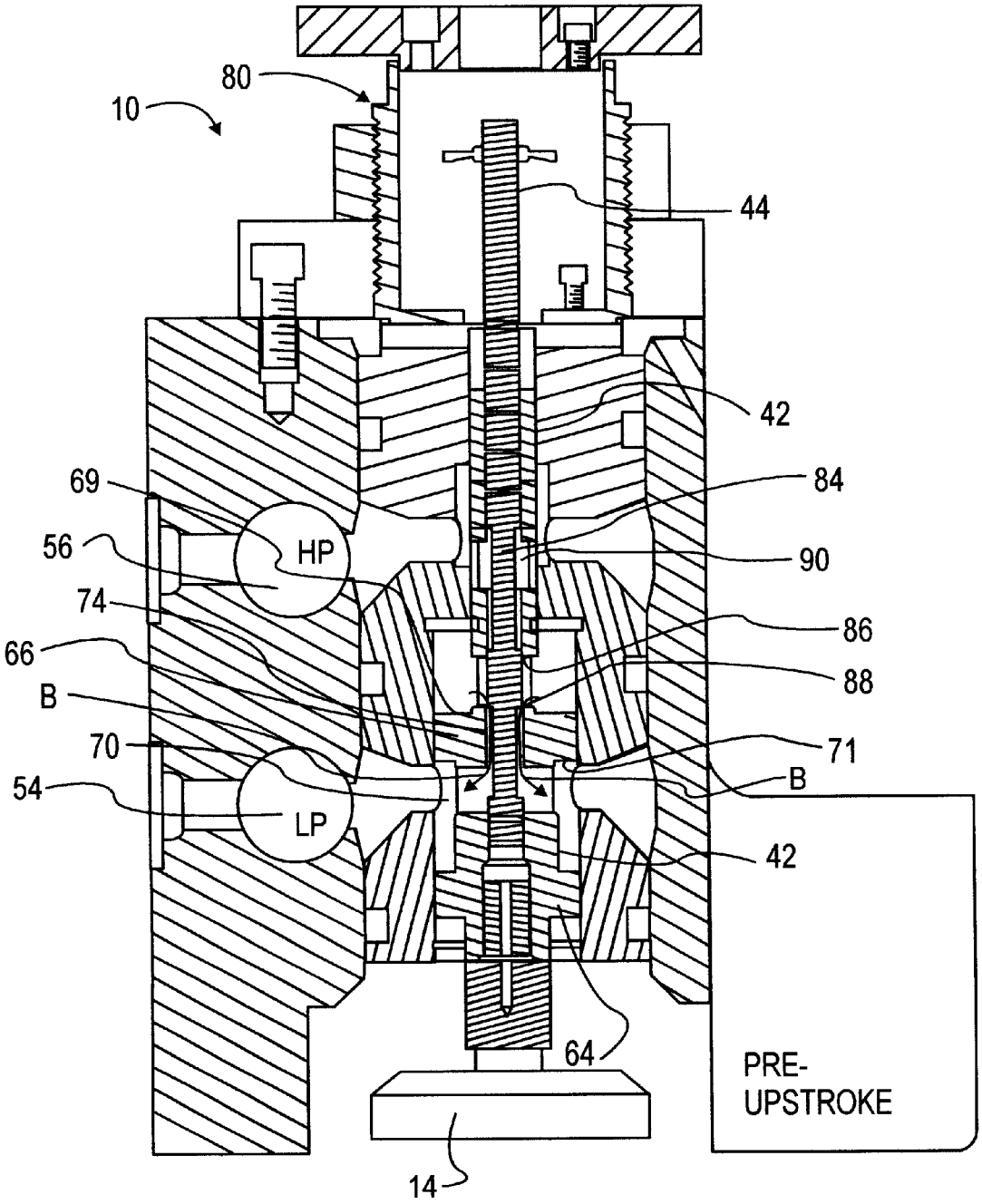
FIG. 5*e* is a side elevational view in section of the valve actuator with the actuator needle commencing upward retraction and the valve in the open extended configuration.

Referring to FIG. 5*e*, the commencement of the upstroke of the valve 14 is depicted. In FIG. 5*e*, the needle 44 has translated upward slightly under the influence of the needle positioning mechanism 80. Such upward translation backs the shoulder 88 out of the sealing engagement with the actuator piston 42. The shoulder 86 remains in sealing engagement with the actuator piston 42. The translation of the needle 44 opens a fluid passageway from the extender chamber 68 through the first groove 82 and then through to the retractor chamber 70. The pressure of the high pressure hydraulic actuating fluid (engine lubricating oil) trapped in the extender chamber 68 is dissipated into the retractor chamber 70 as indicated by the arrows B. With the dissipation of the hydraulic lock as depicted in FIG. 5*d*, there is hydraulic equilibrium in chambers 68, 70 and the bias of the valve spring 26 is therefore free to act on the valve 14 and the actuator piston 42.

Figure 5F:
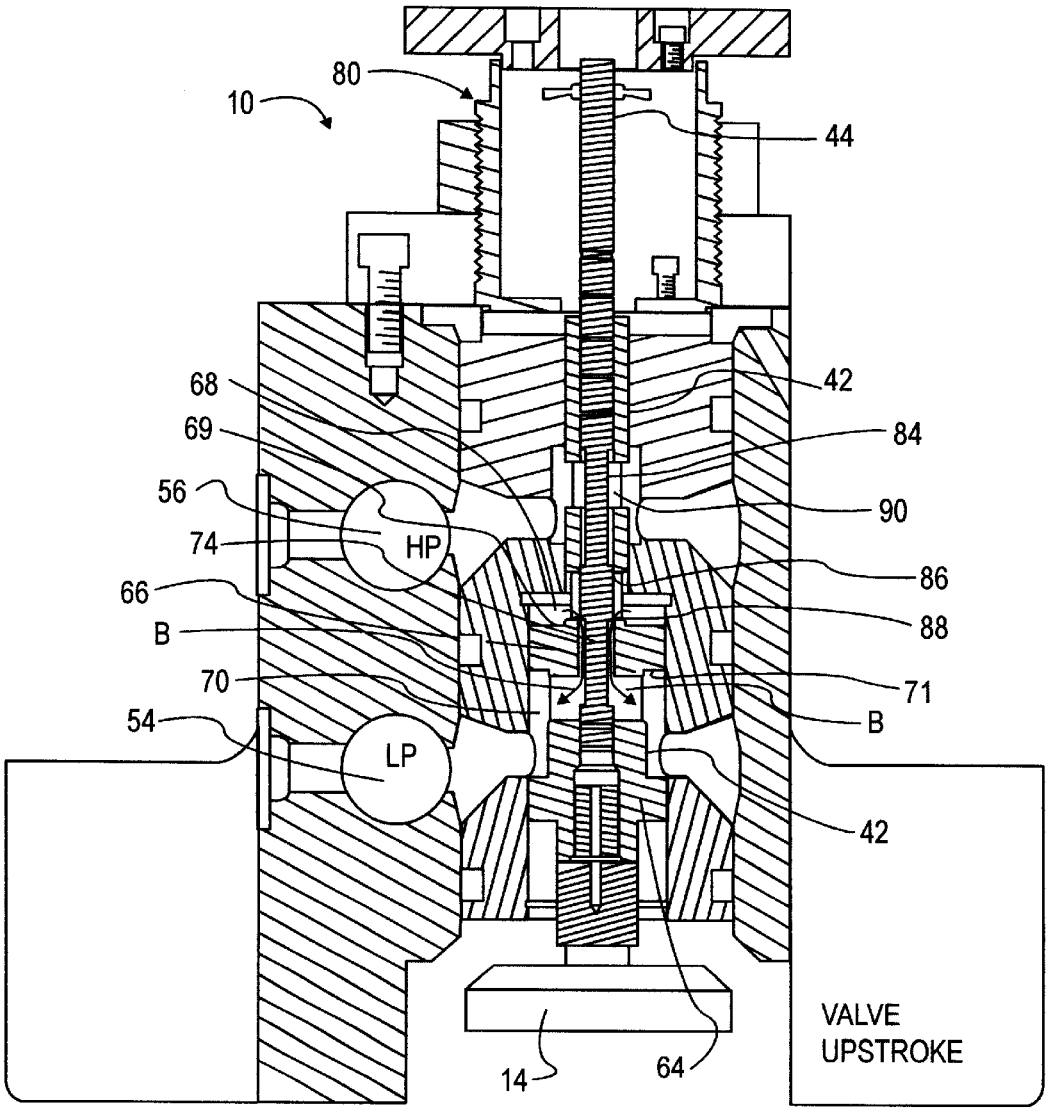
FIG. 5*f* is a side elevational view in section of the valve actuator with the actuator needle and valve in the open extended configuration, the actuator needle having retracted upward exposing the extender chamber to low pressure hydraulic fluid and the valve in the closed retracted configuration.

Referring to FIG. 5*f*, the upward bias of the valve spring 26 (depicted in FIG. 1) acting on the valve 14 forces the actuator piston 42 upward. The upward motion of the actuator piston 42 displaces substantially all the hydraulic actuating fluid from the extender chamber 68 into the retractor chamber 70, as depicted by arrows B. As indicated in FIG. 5*f*, the shoulder 88 is disengaged from the actuator piston 42 to permit the continued flowing of engine lubricating oil from the extender chamber 68 to the retractor chamber 70. The needle 44 retracts upward with the actuator piston 42 causing the shoulder 86 to maintain a sealing engagement with the actuator piston 42, thereby isolating the high pressure engine lubricating oil from the extender chamber 68. This completes the upstroke of the valve 14.

Figure 6:
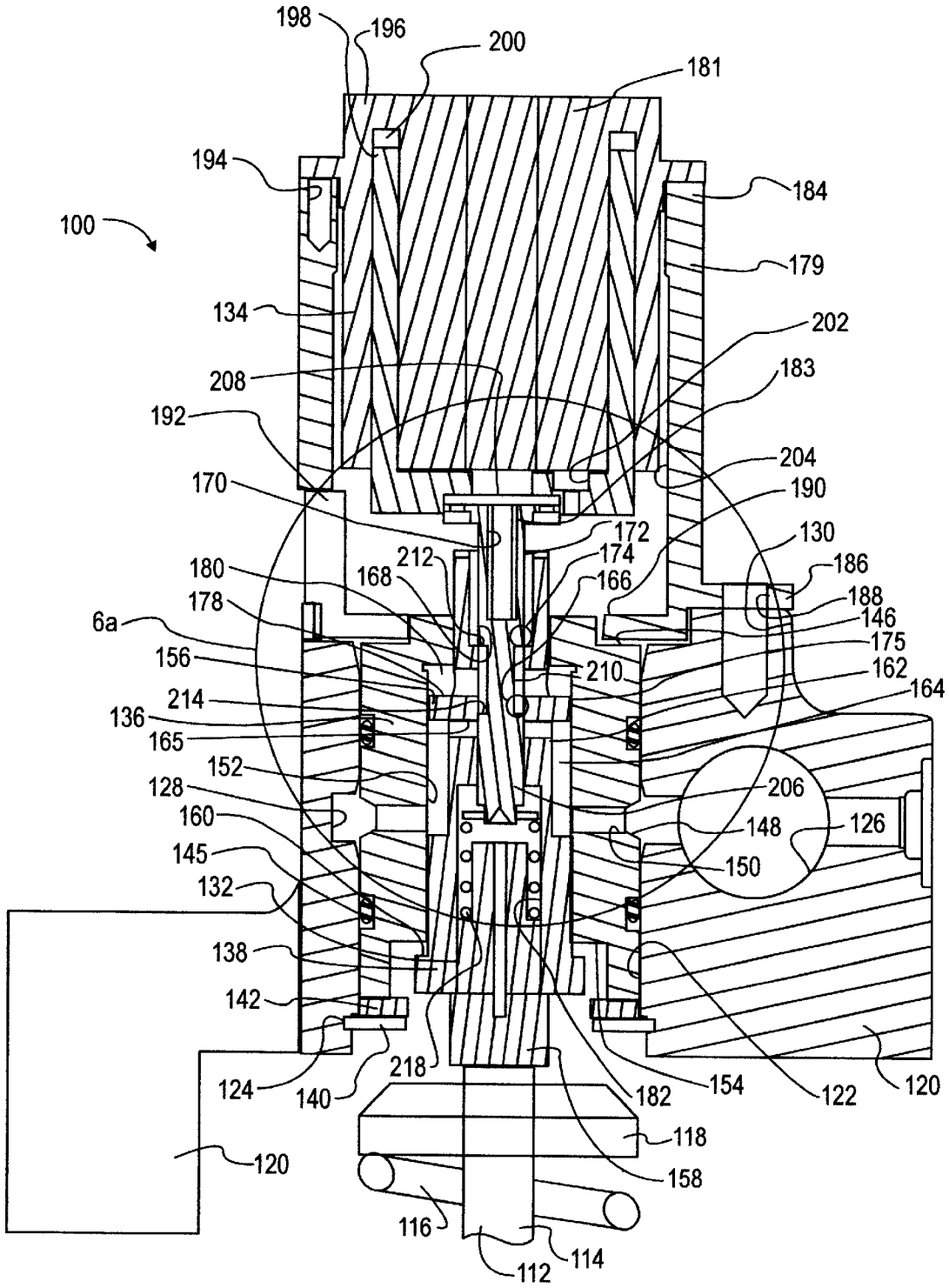
FIG. 6 is a sectional view of an embodiment of an intake valve actuator.
Figure 6A:
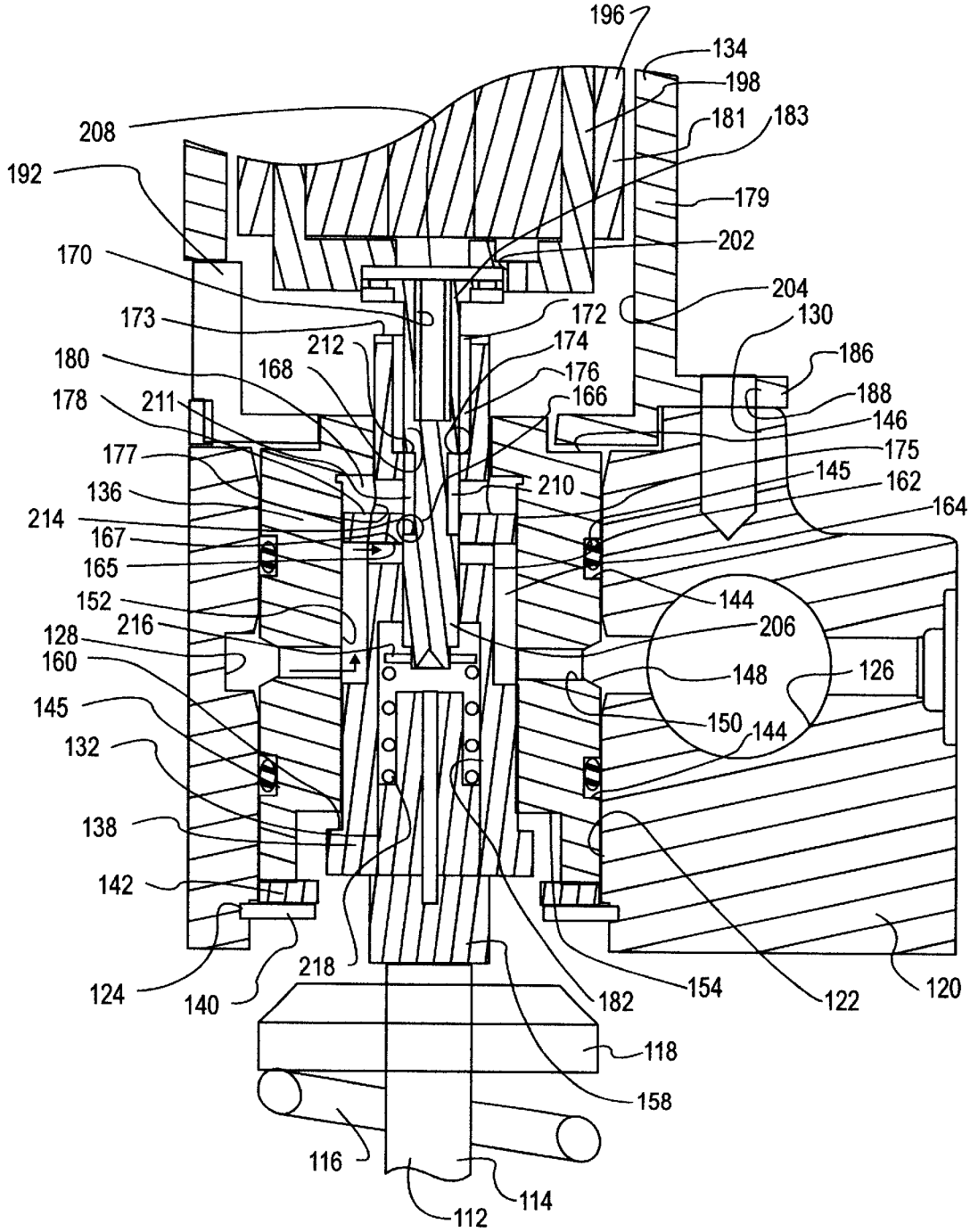
FIG. 6*a* is an enlarged depiction of the portion of FIG. 6 in the circle 6*a*.
Figure 7:
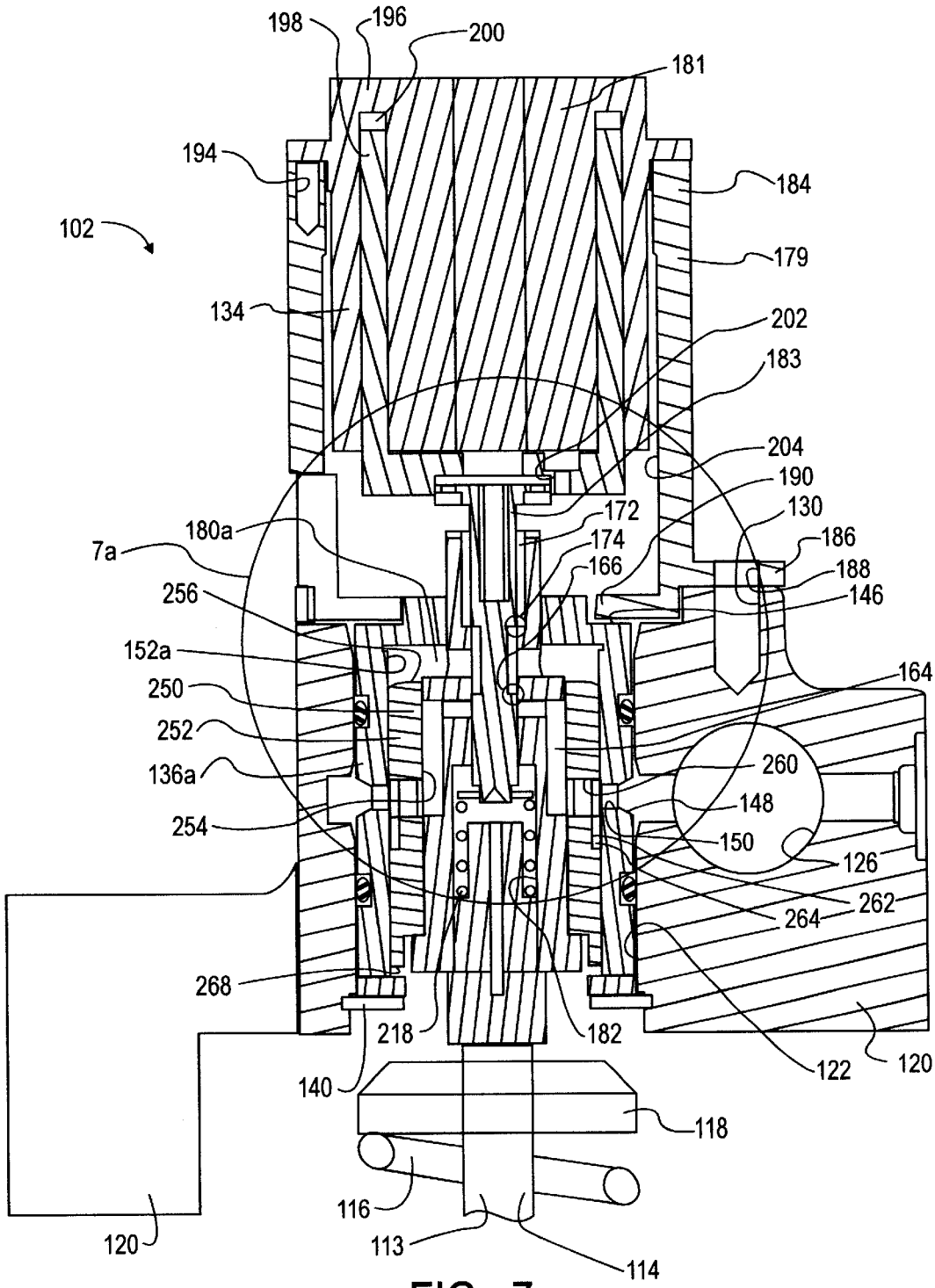
FIG. 7 is a sectional view of an embodiment of an exhaust valve actuator.
Figure 7A:
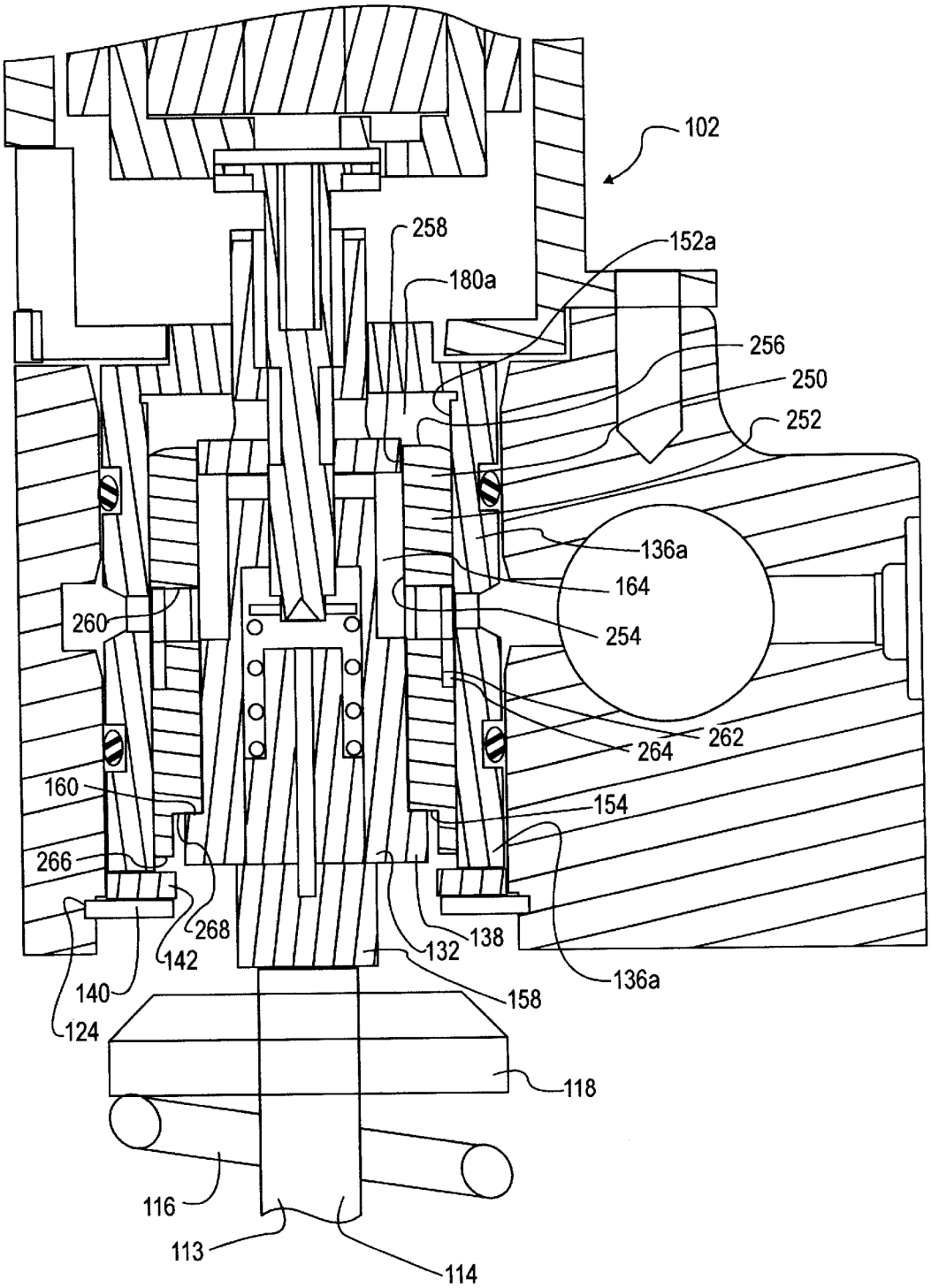
FIG. 7*a* is an enlarged depiction of the portion of FIG. 7 in the circle 7*a*.

A further preferred embodiment of the present invention is depicted in FIGS. 6, 6*a*, 7, and 7*a*. FIGS. 6 and 6*a* depict a sectional view of the valve actuator 100 for use with any intake valve. FIGS. 7 and 7*a* depict a sectional view of a valve actuator 102 for use with an exhaust valve. There are certain components that are common to the valve actuators 100, 102, like numerals being used with reference to both FIGS. 6, 6*a*, 7, and 7*a* to depict common components.

Referring to FIGS. 6 and 6*a*, the valve actuator 100 is utilized with an intake valve 112 disposed in a head 120 of an internal combustion engine, the internal combustion preferably operating on the diesel cycle. The valve 112 has a valve stem 114 and upper end of a valve of a spring 116 is retained by a rotator 118 secured to the valve stem 114 in a conventional manner.

The head 120 has an actuator bore 122 defined therein. A ring groove 124 is defined in the actuator bore 122 proximate the lower margin of the actuator bore 122.

A high pressure rail 126 is defined in the head 120. The high pressure rail 126 conveys a hydraulic medium, preferably, engine lubricating oil. A circumferential oil passage or groove 128 is defined in the actuator bore 122 and is fluidly coupled to the high pressure rail 126. A threaded bore 130 is defined in the head 120 proximate an upper margin of the head 120.

The valve actuator 100 has two major components; actuator assembly 132 and controller assembly 134. The actuator assembly 132 has two major subcomponents; intake casing 136 and a servo piston or actuator piston 138.

The intake casing 136 of the actuator assembly 132 is preferably generally cylindrical in shape and sized to be received within the actuator bore 122 of the head 120. The intake casing 136 is retained within the actuator bore 122 by a retaining ring 140 disposed in the ring groove 124. A spacer washer 142 is interposed between the lower margin of the intake casing 136 and the retaining ring 140. The outer margin of the intake casing 136 has a plurality of O-ring grooves 144 defined therein. O-rings 145 disposed in the O-ring grooves 144 define a substantially fluid-tight seal between the intake casing 136 and the actuator bore 122 of the head 120. An adapter shoulder 146 is defined at the upper margin of the intake casing 136.

The intake casing 136 has a circumferential oil passageway or groove 148 defined in the outer margin of the intake casing 136. When the intake casing 136 is disposed within the actuator bore 122, the circumferential oil passage 148 is continuously fluidly coupled to the circumferential oil passage 128. A plurality of radial oil passageways 150 defined in the intake casing 136 fluidly couple the circumferential oil passageway 148 to a cylinder bore 152 defined within the intake casing 136. Cylinder bore 152 is thereby fluidly coupled to the high pressure rail 126. A circumferential stop shoulder 154 is defined at the lower margin of the cylinder bore 152.

The second subcomponent of the actuator assembly 132 is the actuator piston 138. The actuator piston 138 has a preferably cylindrical piston body 156. The piston body 156 is translatably disposed within the cylinder bore 152 of the intake casing 136. A cap 158 encloses the lower portion of and defines the lower surface of the actuator piston 138. The cap 158 abuts against the end of the valve stem 114 of the valve 112 such that translation of the actuator piston 138 results in simultaneous translation of the valve 112.

An expanded circumference stop shoulder 160 is disposed on the exterior margin of the actuator piston 138 immediately above the cap 158. The stop shoulder 160 comes into contact with the stop shoulder 154 of the intake casing 136 to limit upward travel of the actuator piston 138 in the cylinder bore 152.

The actuator piston 138 is a valve spool and the exterior surface thereof includes a reduced diameter portion or groove 162 defining an annular oil passage 164 in cooperation with the surface of the cylinder bore 152. A plurality of transverse oil passageways 165 extend inward from the oil passage 164 through the body of the piston 138 to provide selective fluid communication with an interior needle bore 168 defined within the actuator piston 138 coaxial with a longitudinal axis thereof. A high pressure throttle area 166 is defined in part by a shoulder 167 that forms the upper intersection of the transverse oil passageway 165 with the needle bore 168.

The actuator piston 138 further includes an expanded diameter needle bore 170. The expanded diameter needle bore 170 defines in part a low pressure oil passage 172. The low pressure oil passage 172 has an opening at the upper margin of the needle bore 168, i.e. at the upper end 173 of the actuator piston 138. A low pressure throttle area 174 is defined in part by a shoulder 176 created by the expansion of the needle bore 168 to expanded portion 170.

Above the circumferential groove 162, the exterior surface of the actuator piston 138 has a portion 175 disposed adjacent the cylinder bore 152 and adjacently thereabove, a reduced diameter portion 177 extending to the end 173 of the actuator piston and defining a pressure bearing surface 178 on the upper side of the portion 175. The pressure bearing surface 178 defines a variable volume pressure chamber 180 in cooperation with the cylinder bore 152 of the intake casing 136 and the reduced diameter exterior surface 177.

A spring cavity 182 is disposed at the lower margin of the needle bore 168. The spring cavity 182 preferably has a greater diameter than the needle bore 168.

The second component of the valve actuator 100 is the controller assembly 134. The controller assembly 134 has three subcomponents; motor adapter 179, motor 181, and needle 183.

The motor adapter 179 has a generally cup-shaped housing 184. A housing flange 186 overlies the threaded bore 130 defined in the head 120. A bore 188 defined in the housing flange 186 is in registry with threaded bore 130. During assembly, a cap screw or similar fastener may be threaded into the threaded bore 130 to affix the valve actuator 100 to the head 120. An inward directed shoulder 190 forms the lower margin of the housing 184. The shoulder 190 bears on a ledge defined in the head 120 and on the adapter shoulder 146 of the intake casing 179 in order to secure the valve actuator 100 within the actuator bore 122 defined in the head 120.

At least one relatively large oil passage 192 is defined in the housing 184. The oil passage 192 is typically at ambient pressure. A relatively small threaded bore 194 is defined in a wall of the housing 184. A cap screw may be threaded into the threaded bore 194 to secure the motor 181 to the motor adapter 179.

The second component of the controller assembly 134 is the motor 181. The motor 181 may be a linear motor that is a product of BEI-Kimko Magnetics, Inc. Other motors may be suitable as well. As depicted, the motor 181 has a stationary core 196. A translatable cylindrical armature 198 is slidably disposed in a cylindrical groove 200 defined in the stationary core 196. A spacer annulus 202 is defined in a lower portion of the armature 198. The lower portion of the armature 198 defines in part a rather voluminous oil gallery 204 The oil gallery 204 is fluidly coupled to the oil passage 192 and is preferably at ambient conditions.

The third component of the controller assembly 134 is the pilot valve or needle 183. The needle 183 has a needle body 206. The needle body 206 is preferably a relatively short generally cylindrical rod. The needle body 206 is fixedly coupled as by screws (not shown) to the lower margin of the translatable armature 198 of the motor 181, a spacer 208 being disposed in the spacer groove 202 of the motor 181 between the armature and the needle body.

The exterior surface of the upper portion of the needle body 206 defines an annular low pressure oil passage 172 in cooperation with the expanded needle bore 170. The central portion of the needle body 206 has a reduced circumference to define a groove 210 which partially defines an annular high pressure oil passageway 211 that may be fluidly coupled to the transverse oil passageway 165 or to the low pressure passage 172 depending on the relative positions of the needle body 206 and the piston 138. The groove 210 has an upper shoulder 212 that defines in part the low pressure throttle area 174 and a lower shoulder 214 that defines in part the high pressure throttle area 166.

The lower portion of the needle body 206 has a spring retainer 216 fixedly coupled thereto to transmit the biasing force of a failure return spring 218 disposed in the spring cavity 182 defined in the actuator piston 181.to the needle 183.

In operation, to open the engine intake valve 112, an electrical signal to the motor 181 causes the armature 198 and the needle 183 to translate downward with respect to the core 196 and the actuator piston 138. As the lower shoulder 214 of the needle groove 210 clears the shoulder 167 of the actuator piston 138 at the high pressure throttle area 166, high pressure actuating fluid from the high pressure rail 126 flows upward through the groove passage 211 to flood the pressure chamber 180. The pressure of the high pressure actuating fluid acting downward on the pressure bearing surface 178 of the actuator piston 138 causes the actuator piston 138 to commence downward travel to cause the opening of the engine intake valve 112.

The rate of downward translation of the needle 183 relative to the actuator piston 138 varies the amount of throttling of the high pressure actuating fluid through the high pressure throttle area 166. Such throttling causes the actuator piston 138 to translate downward at a greater or lesser rate in response to the rate of motion of the needle 183 in order to affect the rate of opening of the valve 112. As the actuator piston 138 translates downward, the oil passage 164 is continuously in fluid communication with the rail 126 and the pressure chamber 180 is continuously in fluid communication with the high pressure actuating oil via the groove passage 211.

The needle 183 stops at its full downstroke. Inertia may carry the actuator piston 138 and the valve 112 further downward slightly after cessation of travel by the needle 183. Such additional translation of the actuator piston 138 relative to the needle 183 will throttle and ultimately halt the flow of high pressure actuating fluid through the high pressure throttle area 166.

To cause closing of the engine valve 112, a further electrical command to the motor 181 causes retraction of the needle 183 relative to the actuator piston 138. At the point that the upper shoulder 212 of the needle slightly passes the shoulder 176 of the actuator piston 138, throttling of low pressure actuating fluid into the low pressure throttle area 174 commences. As the opening between the shoulders 176, 212 increases, high pressure oil in the pressure chamber 180 passes out through the low pressure oil passages 172 into the oil gallery 204 and out of the oil passage 192 to ambient conditions on top of the cylinder head 120, but under the valve cover (not shown), to drain back to the oil pan or other reservoir. With the relief of pressure on the pressure bearing surface 178 of the actuator piston 138, the valve spring 116 acts upwardly on the valve 112 and forces the valve 112 and actuator piston 138 to their initial upward and closed disposition.

In the event that electronic control of the motor 181 were lost, the failure return spring 218 biases the needle 183 in a upward disposition, thereby spilling the high pressure actuating oil in the pressure chamber 180 to ambient via the low pressure oil passage 172, oil gallery 204 and oil passage 192, thereby permitting closing of the valve 112 by the valve spring 116.

The configuration of the present invention that is adapted for use with an exhaust valve is depicted in FIGS. 7 and 7*a*. As indicated above, a concern which arises when using the invention to actuate an exhaust valve is being able to overcome the substantial compressive forces in the cylinder that act to keep the exhaust valve 113 closed. This is especially true during compressive breaking (commonly known as Jake-breaking) of a vehicle. The valve actuator of the present invention adapted for use with an exhaust valve 113 is shown generally at 102 in the figures. The valve actuator 102 includes substantially all of the components previously described with reference to the valve actuator 100. In addition to the components of the valve actuator 100, the valve actuator 102 incorporates a power piston 250. The power piston 250 is disposed radially with respect to the actuator piston 138.

The power piston 250 includes a power piston body 252. The power piston body 252 is translatably disposed within a cylinder bore 152*a* defined within the exhaust casing 136*a*. The wall thickness of the exhaust casing 136*a* is reduced as compared to the intake casing 136, described above, to define a cylinder bore 152*a* that is greater in diameter than the cylinder bore 152 defined in the intake casing 136. The inner margin of the power piston body 252 defines a cylinder bore 254. The cylinder bore 254 has substantially the same dimensions as the cylinder bore 152 defined in the intake casing 136 of the intake valve actuator 100. The actuator piston 138 is translatably disposed within the cylinder bore 254. Thus, the power piston 250 is free to translate relative to the exhaust casing 136*a* and the actuator piston 138 is free to translate relative to the power piston 250 and the needle 183 is free to translate relative to the actuator piston 138.

The power piston body 252 has an upper margin that defines a slightly domed pressure bearing surface 256. The domed pressure bearing surface 256 defines in part an expanded volume pressure chamber 180*a*. A bore aperture 258 is defined at the upper margin of the cylinder bore 254. In the retracted disposition of FIG. 7, the pressure bearing surface 178 of the actuator piston 138 and the domed pressure bearing surface 256 of the power piston 250 may be nearly flush with one another.

Moving downward on the power piston 250, an oil passage 260 is defined through the piston body 252. At its inner margin, oil passage 260 is in flow communication with the spool oil passage 164 defined by the annular groove 162 of the actuator piston 138. At its outer margin, oil passage 260 is in fluid communication with an annular oil passage 264 defined by annulus 262 disposed in the power piston body 252 and with the passageway 150 defined in the exhaust casing 136*a*.

The power piston body 252 presents a lower margin 266. In the retracted disposition of FIGS. 7 and 7*a*, the lower margin 266 is spaced apart a slight distance from the washer 142. The washer 142 acts as a stop limiting the downward travel of the power piston 250. A stop shoulder 268 is presented inward and slightly upward of the lower margin 266. The stop shoulder 268 acts to limit the upward travel of the actuator piston 138.

During normal operation, typical pressures of the high pressure actuating fluid in the rail 126 are between 500 and 1,000 psi. Such pressures are sufficient to overcome normal cylinder gas pressures. However, the pressure in the rail 126 may be commanded to increase to as much as 4,000 psi, thus enabling the valve 112 to overcome much higher pressures that may be experienced, for example, during compression braking. The power piston 250 of the present invention is always operational, translating downward and upward over its very limited range of motion for each opening and closing cycle of the exhaust valve 113.

In operation, the valve actuator 102 commences translation identically to that described above with reference to the valve actuator 100. The initial downward translation of the needle 183 causes the high pressure actuating fluid to flood the expanded volume pressure chamber 180*a*. The pressure in the expanded volume pressure chamber 180*a* generates a force acting downward on both the pressure bearing surface 178 of the actuator piston 138 and the domed pressure bearing surface 256 of the power piston 250. The force generated by the high pressure actuating fluid substantially simultaneously causes the downward translation of the actuator piston 138 and also the power piston 250. The power piston 250 force is only needed to crack open the exhaust valve 113 against the very high compression forces due to cylinder firing that may be acting to hold the valve 113 in the closed disposition. Once the valve 113 is cracked open just a slight amount, the high compression forces in the combustion chamber escape and the downward thrust of the actuator piston 138 is adequate to continue the opening process of the exhaust valve 113. Accordingly, the downward stroke of the power piston 250 is limited to a very short distance as indicated by the very small distance between the lower margin 266 of the power piston body 252 and the washer 142. When the power piston 250 comes into contact with the washer 142, the downward stroke of the power piston 250 is arrested while the actuator piston 138 continues its downward stroke translating relative to the now-stopped power piston 250. An advantage of limiting the stroke of the power piston 250 is that it significantly reduces the volume of high pressure actuating fluid necessary to effect an opening stroke of the exhaust valve 113. Minimizing this volume is an important consideration when designing the auxiliary components necessary to supply the high pressure rail 126.

The closing stroke of the exhaust valve 113 is effected in substantially the same manner as that previously described for the intake valve actuator 100. As the actuator piston 138 commences its upward travel, the stop shoulder 160 of the actuator piston 138 comes into contact with the stop shoulder 268 of the power piston 250. When such contact is made, the actuator piston 138 continues its upward travel under influence of the valve spring 116, carrying with it the power piston 250.

Variations within the spirit and scope of the invention described are equally comprehended by the foregoing description.

What is claimed is:

1. A hydraulically-assisted engine valve actuator for assisting a valve spring in the actuation of a valve, comprising:

an actuator piston being operably coupled to the engine valve for actuation of the engine valve and being translatable by a force acting thereon, the force being generated by a fluid under pressure; and a translatable needle valve translatably disposed in a cylinder defined in the actuator piston, the needle valve being in fluid communication with a source of fluid under pressure and further being in fluid communication with the actuator piston, the needle valve effecting the metering of the fluid under pressure to generate the force on the actuator piston via not more than a single fluid passage, the fluid passage being defined at least in part by a needle valve surface.

2. The hydraulically-assisted engine valve actuator of claim 1 wherein the not more than a single fluid passage is defined annularly between a needle valve groove and the cylinder.

3. The hydraulically-assisted engine valve actuator of claim 2 wherein the actuator piston overcomes a bias exerted by a valve spring to effect an opening translation of the valve.

4. The hydraulically-assisted engine valve actuator of claim 3 wherein a rate of translation of the actuator is related to a rate of translation of the needle valve to effect a desired opening and closing profile of the engine valve.

5. The hydraulically-assisted engine valve actuator of claim 2 wherein the actuator piston resists the bias exerted by the valve spring to effect a closing translation of the valve.

6. The hydraulically-assisted engine valve actuator of claim 5 wherein the rate of translation of the needle valve is related to the rate of translation of the actuator piston to effect a desired closing profile of the engine valve.

7. The hydraulically-assisted engine valve actuator of claim 1 wherein the translatable needle valve is translatable at a desired and selectively variable rate, the actuator piston closely following the translation of the needle valve to effect desired engine valve opening and closing profiles.

8. The hydraulically-assisted engine valve actuator of claim 1 wherein the translatable needle valve is translated by force of less than twelve pounds.

9. The hydraulically-assisted engine valve actuator of claim 1 wherein the actuator piston is translated by a hydraulic fluid exerting a force of more than four hundred pounds per square inch.

10. The hydraulically-assisted engine valve actuator of claim 1 wherein a needle positioning mechanism is operably coupled to the needle valve, the needle positioning mechanism being selected from mechanisms consisting of a solenoid, a cam lobe, a linear motor, and a stepper motor.

11. The hydraulically-assisted engine valve actuator of claim 1 wherein the actuator piston has a generally elongate cylindrical shape and has a first end operably coupled to the engine valve and a second end opposed thereto, an axial bore being defined in the actuator piston extending from the second end at least a portion of a longitudinal dimension of the actuator piston.

12. The hydraulically-assisted engine valve actuator of claim 11 further including an actuator casing, the actuator casing having an axial cylinder bore defined therein, wherein the actuator piston has a pressure bearing piston head surface, the piston head surface being translatably disposed in the cylinder bore.

13. The hydraulically-assisted engine valve actuator of claim 12 wherein the pressure bearing piston head surface defies in part a pressure chamber, the pressure chamber being selectively in fluid communication with a fluid gallery, the fluid gallery being at substantially ambient pressure.

14. The hydraulically-assisted engine valve actuator of claim 1 wherein the needle valve has a generally elongate cylindrical shape and has a first end being operably coupled to a return spring, the return spring biasing the needle valve in a retracted, closed disposition.

15. The hydraulically-assisted engine valve actuator of claim 14 wherein the return spring is disposed in a spring receiver defined in the actuator piston.

16. The hydraulically-assisted engine valve actuator of claim 1 wherein the fluid passage acts to selectively meter actuating fluid to an actuator pressure bearing piston head surface responsive to translation of the needle valve relative to the actuator piston.

17. A hydraulically-assisted engine valve actuator for assisting a valve spring in the actuation of an engine valve, comprising:

a servo piston being g operably coupled to the engine valve;

a power piston being operably coupled to the engine valve;

a translatable pilot valve being in fluid communication with the servo piston and the power piston and being operably coupled to and controlled by a pilot valve positioning system, the pilot valve positioning system controlling a translational stroke of the pilot valve to meter hydraulic fluid under pressure to and from the servo piston.

18. The hydraulically-assisted engine valve actuator of claim 17 wherein the metered hydraulic fluid under pressure causes the servo piston to closely follow the translation of the pilot valve to effect a desired profile of translational opening and closing motion of the engine valve, the hydraulic fluid under pressure further causing the power piston to closely follow the translation of the pilot valve for at least a portion of the translational stroke of the pilot valve to assist in effecting an initial opening motion of the engine valve.

19. The hydraulically-assisted engine valve actuator of claim 18 wherein the servo piston is translationally disposed in a cylinder bore defined in the power piston.

20. The hydraulically-assisted engine valve actuator of claim 19 wherein rate of translation of the servo piston and the power piston is related to rate of translation of the pilot valve to effect a desired opening profile of the engine valve.

21. The hydraulically-assisted engine valve actuator of claim 18 wherein the servo piston resists the valve closing bias exerted by the valve spring.

22. The hydraulically-assisted engine valve actuator of claim 21 wherein the rate of translation of the servo piston is related to the rate of translation of the pilot valve to effect a desired closing profile of the engine valve.

23. The hydraulically-assisted engine valve actuator of claim 17 wherein the translatable pilot valve is translatable at a selectively variable rate, the servo piston closely following the translation of the pilot valve to effect desired engine valve opening and closing profiles.

24. The hydraulically-assisted engine valve actuator of claim 17 wherein the power piston is operably couplable to the servo piston by selective engagement of a servo piston stop means with a power piston first stop means.

25. The hydraulically-assisted engine valve actuator of claim 24 wherein a force generated by the hydraulic fluid acting on the power piston is transmitted to the engine valve by means of the selective engagement of the servo piston stop means with the power piston first stop means.

26. The hydraulically-assisted engine valve actuator of claim 25 wherein a power piston second stop arrests the opening stroke of the power piston thereby limiting the stroke of the power piston to that necessary to initially open the engine valve.

27. The hydraulically-assisted engine valve actuator of claim 26 wherein the servo piston stroke continues after the arresting of the power piston stroke, thereby disengaging the servo piston stop means from the power piston first stop means, the continuing servo piston stroke acting to more fully open the engine valve.

28. The hydraulically-assisted engine valve actuator of claim 27 wherein retraction of the servo piston under the influence of an engine valve spring acts to re-engage the servo piston stop means and the power piston first stop means, the continuing servo piston retraction stroke acting to simultaneously retract the power piston.

29. The hydraulically-assisted engine valve actuator of claim 17 further including an actuator casing, the actuator casing, having an axial cylinder bore defined therein, the power piston having a pressure bearing piston head surface, the piston head surface being translatably disposed in the cylinder bore.

30. The hydraulically-assisted engine valve actuator of claim 29 wherein the actuator casing is fluidly coupled to a source of high pressure hydraulic fluid and is fluidly coupled to the servo piston for transmission of the high pressure hydraulic fluid thereto.

31. A method of actuation of an engine valve, comprising the steps of:

operably coupling a servo piston to the engine valve;

operably coupling a power piston to the servo piston;

translating a pilot valve responsive to control inputs by a pilot valve positioning system for metering hydraulic fluid by means of translation of the pilot valve relative to the servo piston to affect the servo piston and the power piston;

translating the engine valve in cooperation with a valve spring by means of translating the servo piston and the power piston by means of a force exerted on the servo piston and the power piston by the hydraulic fluid under pressure, the hydraulic fluid under pressure causing the servo piston to closely follow the translation of the pilot valve to effect a desired profile of translational opening and closing motion of the engine valve.

32. The method of claim 31 wherein the force exerted on the servo piston by the hydraulic fluid under pressure acts in opposition to a force exerted by a valve spring, the valve exerting a bias on the engine valve to urge the engine valve into a closed position.

33. The method of claim 31 wherein the pilot valve is controlled by a force of less than twelve pounds.

34. The method of claim 31 wherein the servo piston is translatable by a force of more than four hundred pounds.

35. A hydraulically-assisted engine valve actuator for assisting in the actuation of a valve, comprising:

an actuator piston being operably coupled to the engine valve for actuation of the engine valve and being translatable by a force acting thereon, the force being generated by a fluid under pressure; and a translatable needle valve translatably disposed in a cylinder defined in the actuator piston, the needle valve being in fluid communication with a source of fluid under pressure and further being in fluid communication with the actuator piston, the needle valve effecting the metering of the fluid under pressure to generate the force on the actuator piston via not more than a single fluid passage, the fluid passage being defined at least in part by a needle valve surface, the translatable needle valve being translatable at a desired and selectively variable rate, the actuator piston closely following the translation of the needle valve to effect desired engine valve opening and closing profiles.

36. The hydraulically-assisted engine valve actuator of claim 35 wherein the not more than a single fluid passage is defined annularly between a needle valve spool groove and the cylinder.

37. The hydraulically-assisted engine valve actuator of claim 36 wherein the actuator piston overcomes a bias exerted by a valve spring to effect an opening translation of the valve.

38. The hydraulically-assisted engine valve actuator of claim 37 wherein a rate of translation of the actuator is related to a rate of translation of the needle valve to effect a desired opening and closing profile of the engine valve.

39. The hydraulically-assisted engine valve actuator of claim 36 wherein the actuator piston resists the bias exerted by the valve spring to effect a closing translation of the valve.

40. The hydraulically-assisted engine valve actuator of claim 39 wherein the rate of translation of the needle valve is related to the rate of translation of the actuator piston to effect a desired closing profile of the engine valve.

41. A hydraulically-assisted engine valve actuator for assisting in the actuation of an engine valve, comprising:

a servo piston being g operably coupled to the engine valve;

a power piston being operably coupled to the engine valve;

a translatable pilot valve being in fluid communication with the servo piston and the power piston and being operably coupled to and controlled by a pilot valve positioning system, the pilot valve positioning system controlling a translational stroke of the pilot valve to meter hydraulic fluid under pressure to and from the servo piston, the translatable pilot valve being translatable at a selectively variable rate, the servo piston closely following the translation of the pilot valve to effect desired engine valve opening and closing profiles.

42. The hydraulically-assisted engine valve actuator of claim 41 wherein the metered hydraulic fluid under pressure causes the servo piston to closely follow the translation of the pilot valve to effect a desired profile of translational opening and closing motion of the engine valve, the hydraulic fluid under pressure further causing the power piston to closely follow the translation of the pilot valve for at least a portion of the translational stroke of the pilot valve to assist in effecting an initial opening motion of the engine valve.

43. The hydraulically-assisted engine valve actuator of claim 42 wherein the servo piston is translationally disposed in a cylinder bore defined in the power piston.

44. The hydraulically-assisted engine valve actuator of claim 43 wherein rate of translation of the servo piston and the power piston is related to rate of translation of the pilot valve to effect a desired opening profile of the engine valve.

45. The hydraulically-assisted engine valve actuator of claim 42 wherein the servo piston resists the bias exerted by the valve spring to effect a closing translation of the valve.

46. The hydraulically-assisted engine valve actuator of claim 45 wherein the rate of translation of the servo piston is related to the rate of translation of the pilot valve to effect a desired closing profile of the engine valve.

* * * * *